US005737781A

United States Patent [19]

Votel

[11] Patent Number: 5,737,781

[45] Date of Patent: Apr. 14, 1998

[54] PATIENT TRANSFER SYSTEM

[75] Inventor: Thomas W. Votel, St. Paul, Minn.

[73] Assignee: Ergodyne Corporation, St. Paul, Minn.

[21] Appl. No.: 527,519

[22] Filed: Sep. 13, 1995

[51] Int. Cl.[6] ..... A61G 7/10

[52] U.S. Cl. ..... 5/81.1 HS; 5/81.1 R; 5/84.1; 5/88.1; 24/498; 24/460; 24/265 EC

[58] Field of Search ..... 5/81.1 HS, 81.1 R, 5/83.1, 84.1, 86.1, 88.1, 89.1; 24/265 EC, 460, 462, 498

[56] References Cited

U.S. PATENT DOCUMENTS

| | | | |
|---|---|---|---|
| 1,815,006 | 7/1931 | Horsting et al. | 24/498 |
| 2,710,975 | 6/1955 | Stoen et al. . | |
| 2,761,153 | 9/1956 | Mew . | |
| 2,826,766 | 3/1958 | Stoner . | |
| 2,827,642 | 10/1958 | Huff . | |
| 3,597,774 | 8/1971 | Warren . | |
| 4,194,253 | 3/1980 | Ullven | 5/84.1 |
| 4,747,170 | 5/1988 | Knouse | 5/81.1 HS |
| 4,776,047 | 10/1988 | Dimatteo . | |
| 4,850,562 | 7/1989 | Mazzanti | 24/460 |
| 4,868,938 | 9/1989 | Knouse . | |
| 5,072,840 | 12/1991 | Asakawa et al. | 5/83.1 |
| 5,168,587 | 12/1992 | Shutes . | |
| 5,271,110 | 12/1993 | Newman . | |
| 5,379,468 | 1/1995 | Cassidy . | |
| 5,539,941 | 7/1996 | Fuller | 5/88.1 |

FOREIGN PATENT DOCUMENTS

| | | | |
|---|---|---|---|
| 2 257 572 | 11/1972 | Germany . | |
| 2 308 436 | 2/1973 | Germany . | |
| 7869 | of 1895 | United Kingdom | 24/498 |
| 2068850 | 8/1981 | United Kingdom . | |

*Primary Examiner*—Steven N. Meyers
*Assistant Examiner*—Robert G. Santos
*Attorney, Agent, or Firm*—Patterson & Keough, P.A.

[57] ABSTRACT

The invention includes several novel devices for transferring patients. A first system of horizontal transfer of patients is adapted to use existing transfer sheets and cart appropriately modified. The sheet is attached to a clamping device that has a releasable catch that holds the sheet in a cavity. A plurality of straps are attached to the clamping device. The other ends of the straps are attached to reels that are part of a winch. Activation of the winch winds the straps onto the reels. Other designs of horizontal transfer devices are included within the invention. The invention also includes improved bed jackets that can be attached to, a winch for lifting a patient either to re-position them on a surface or to transport them. The invention also includes cushions and side rails with very low friction surfaces to assist with the transfer process.

25 Claims, 23 Drawing Sheets

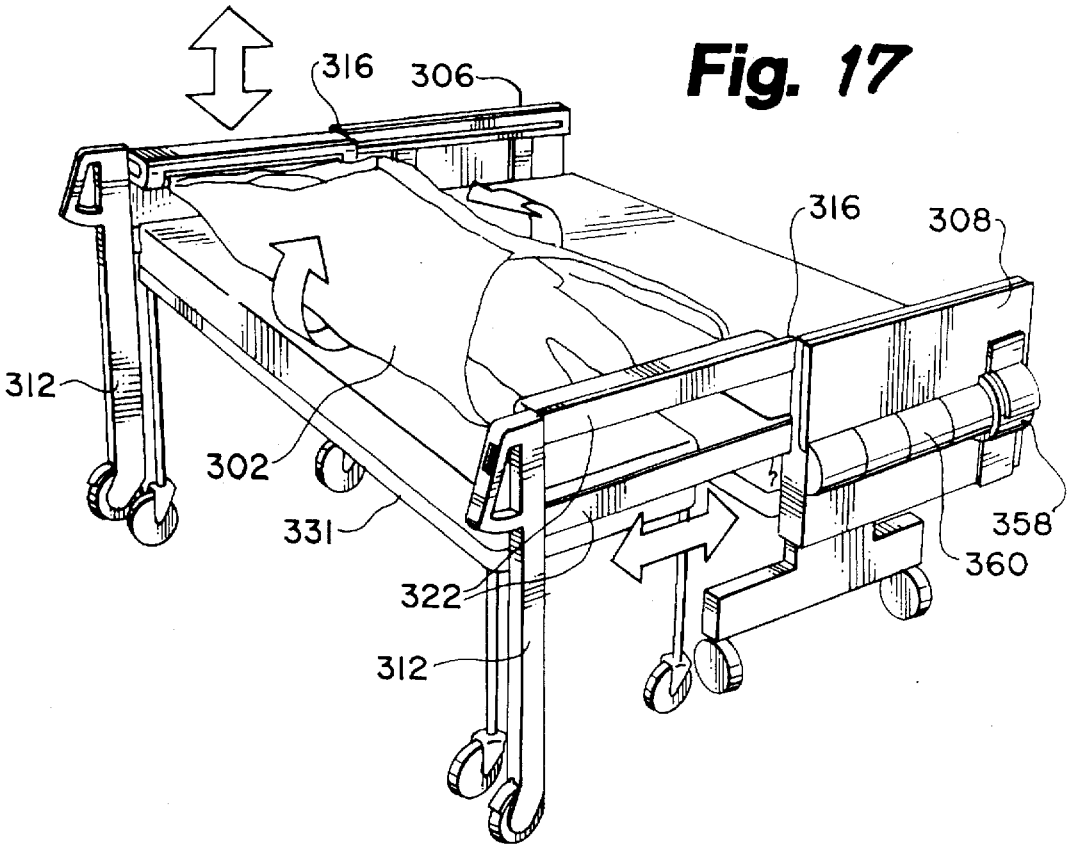
Fig. 17
Fig. 20b
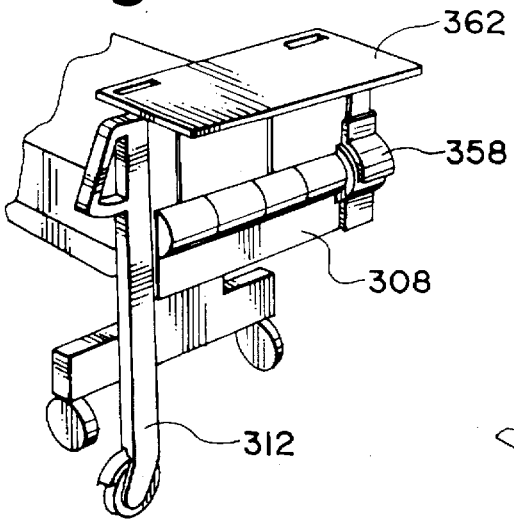
Fig. 20a
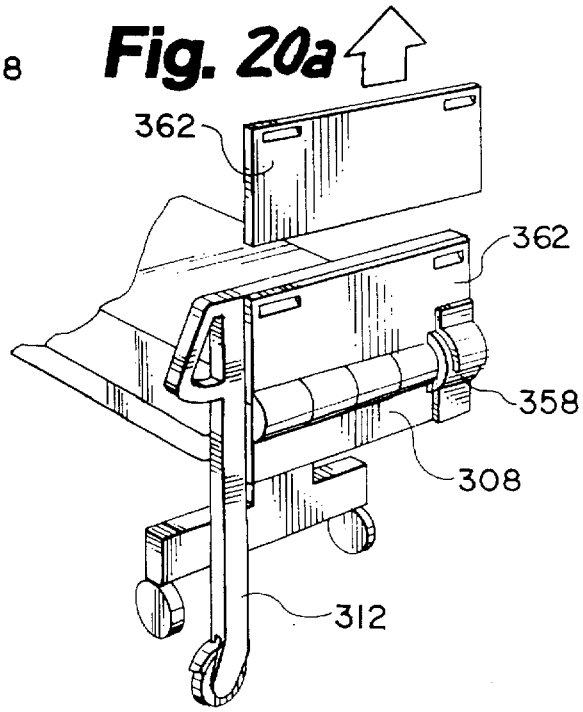

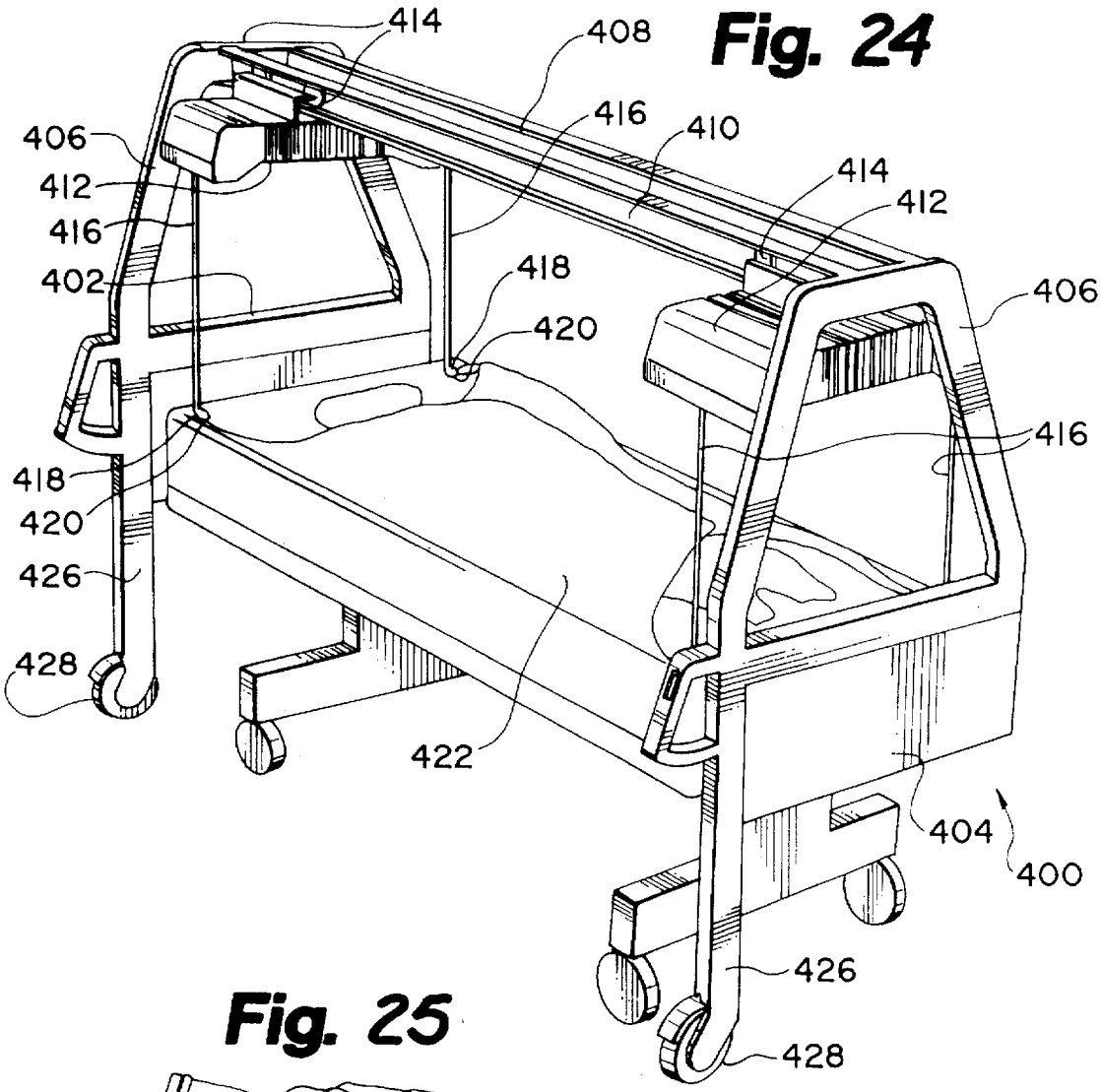
Fig. 24
Fig. 25
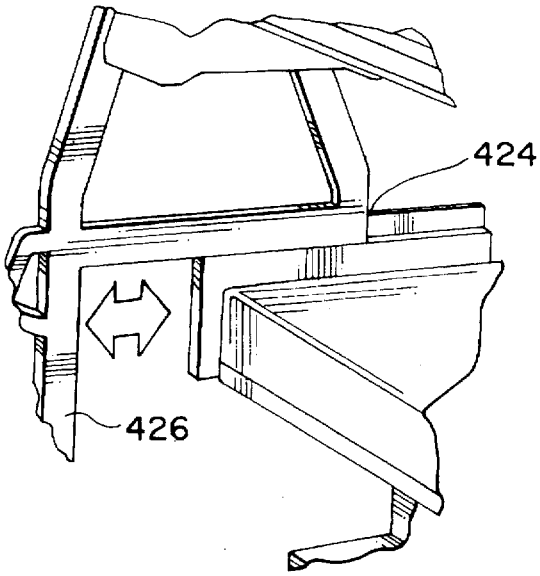

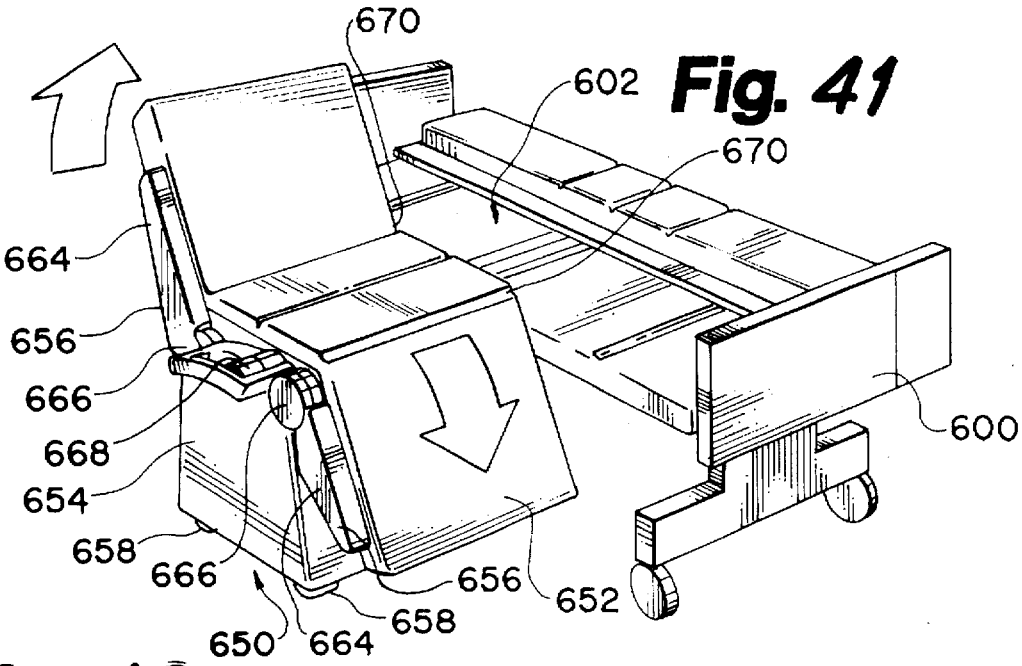
Fig. 41
Fig. 42
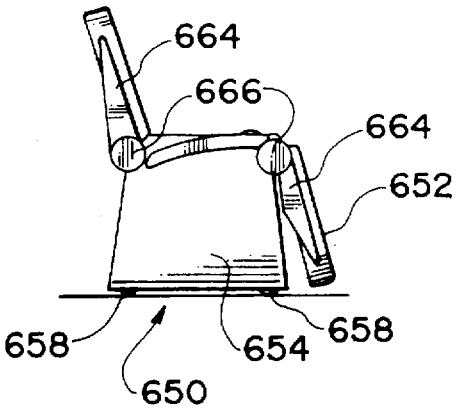
Fig. 43a
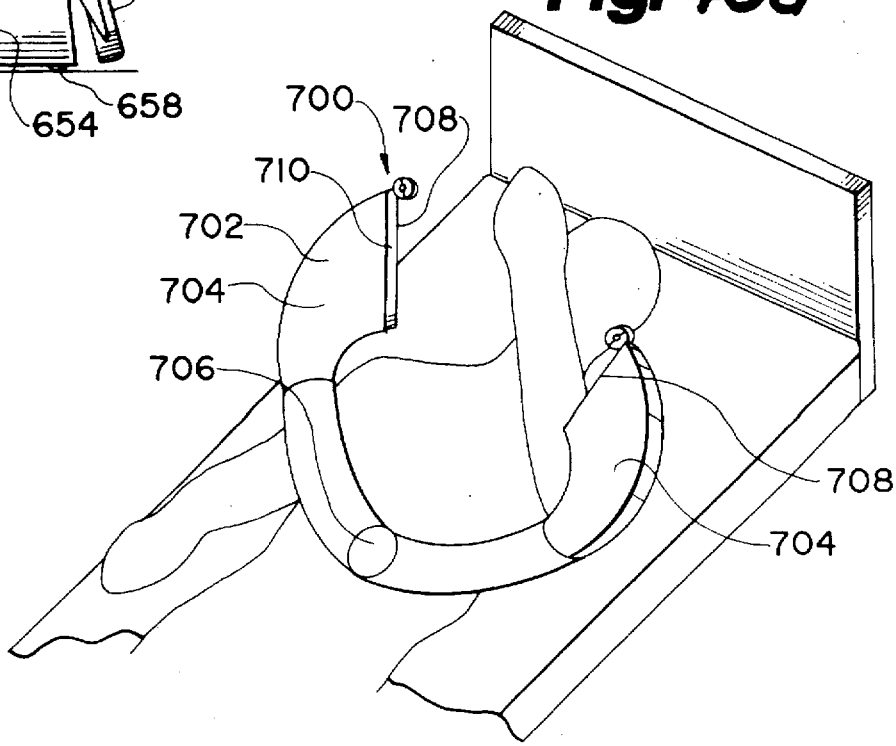

Fig. 43b
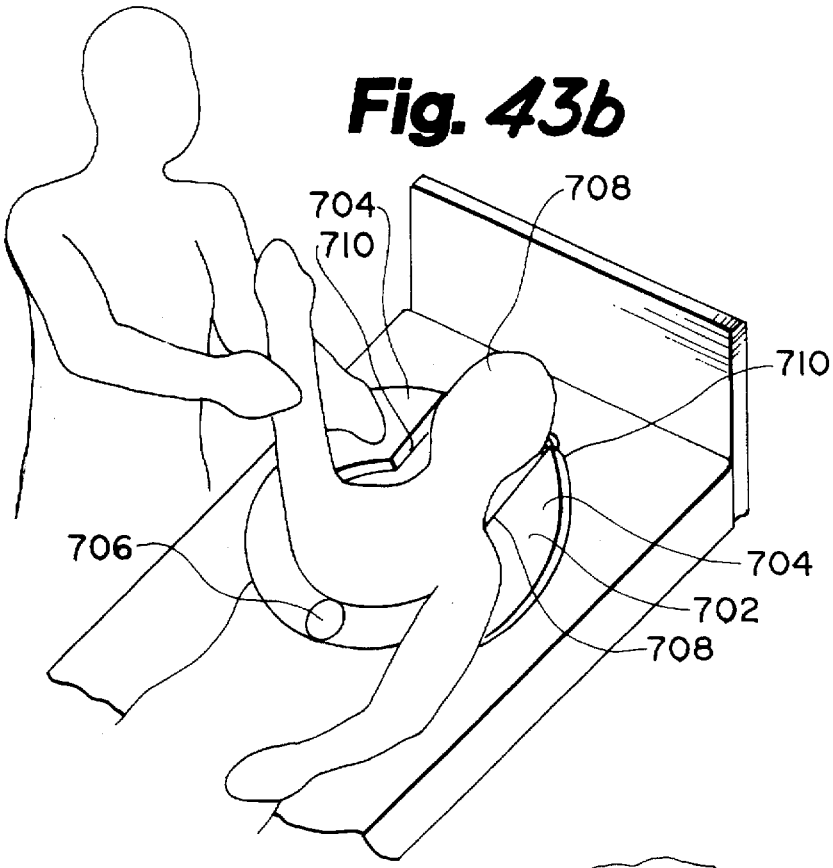
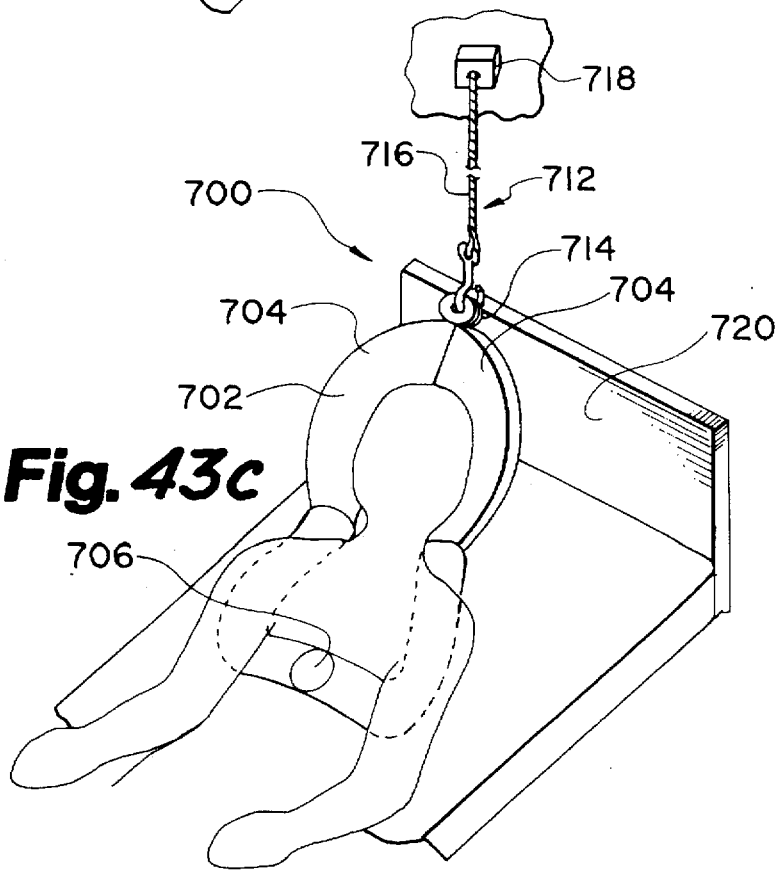
Fig. 43c

PATIENT TRANSFER SYSTEM

FIELD OF THE INVENTION

The invention relates to systems which assist with the movement of patients who are partly or completely incapacitated. The invention more particularly relates to systems which give a single health care worker the capability to move a patient between a bed and a cart, between a sitting and a standing position or between a slumped position in a chair or bed and a more elevated position.

BACKGROUND OF THE INVENTION

Health care workers at hospitals, nursing homes, and home care programs face the challenge of moving partly or completely incapacitated patients. A typical patient weighs between 100 and 200 pounds, and two to four health care workers are usually needed to move the patient. These activities create unacceptable risks of injury, almost without regard to the number of health care workers used in the patient transfer. The risks are particularly high when a sufficient number of workers is not available to assist. Injuries to worker's backs, which account for approximately 50% of worker's compensation costs in the health care industry, are a particular problem.

Patient transfers can be placed in three broad categories. The first category includes the horizontal transfer of a patient from one flat surface to another. The second category involves upright transfers where a patient is moved from a horizontal position to an upright position or a sitting position in a wheelchair, chair or commode and the return of the patient to the horizontal position from an upright or sitting position. The third category of transfer relates to the movement of patients to change their position in a bed or chair, such as pulling the patient up in the bed or rolling the patient from side to side. Although many attempts have been made to devise improved systems for patient transfer, almost all of these transfers are continue to be manually performed.

Present procedures for horizontal transfers recommend that four healthcare workers participate in the transfer. Two workers are at the bed side and two workers are at the cart side. Each worker grabs an edge of a draw sheet which is under the patient. Through a combination of lifting, pulling, and pushing, the patient is transferred between the bed and the cart. An elongated plastic sheet is often used to reduce the friction during the transfer. Since the healthcare workers have to lean over either the bed or the cart, the stresses on the workers are magnified well beyond the maximum recommended lift of approximately fifty pounds. This recommended maximum lift is measured with the lift at or near the center of mass of the worker. Extremes in the health care worker's height, either too tall or too short, or any common weakness in either the arms or legs of such workers exaggerate these patient transfer problems. Most hospitals have swing type lifts, but these devices are not widely used.

The upright transfer and positioning categories provide similar difficulties especially if the patient is unable to cooperate. For example, weak and elderly patients reclining in a semi-erect position tend to slide down. These patients must be pulled toward the end of the bed. Two health care workers usually attempt to do this by grasping the patient by the upper arms to elbows to hoist the patient toward the head of the bed after the bed has been flattened. This motion results in strain on the workers' upper and lower back and possible contact bruises on the patient. Similar difficulties occur with upright transfers.

Given these formidable difficulties, there have been other attempts to mechanize the patient transfer process. For example, U.S. Pat. No. 2,665,432 (Butler), describes a cart with a manual crank connected to an extensive pull unit. The pull unit has a large number of straps which connect at an edge by hooks to a transfer sheet. Rotation of the crank winds the pull unit onto a roller. The size of the pull unit presents many difficulties including its attachment at many locations to the sheet and the awkwardness of winding it on the roller. The pull unit must be placed under the person since it would not be kept under the person at all times. No way is provided for transferring the patient off of the cart. U.S. Pat. No. 2,827,642 (Huff) describes a similar system mounted to the head of a bed to help move a patient from the foot of the bed to the head of the bed. The '642 Patent does not describe the process of moving a patient from one horizontal surface to another.

U.S. Pat. No. 4,970,738 (Cole) discloses another patient transfer system on a wheeled cart based on a manual crank. This system has the advantage over the system described in the '432 Patent in that the transfer is reversible. The crank is connected to a reversible gear box. Rotation of the crank moves belts which are attached to a semi-rigid transfer support which is transferred horizontally while supporting a patient. This system has the disadvantages that the patient must be moved onto the transfer support to move the patient from a bed onto the cart and that the transfer support does not provide sufficient support for the patient or the transfer system. Because of the complicated pulley system with six clamps just supported by a semi-rigid support which extends past the edge of the cart, considerable operator interaction would be needed as the transfer support is moved on and off the cart to ensure that the transfer support is properly supported by the intended surfaces.

U.S. Pat. No. 2,733,452 (Tanney) describes a transfer system that uses a motorized pulley to transfer a patient on a metal reinforced transfer sheet. The transfer sheet has metal grommets in its corners for the attachment of cables. A motor is used to wind the cable onto reels resulting in the transfer of the sheet. The patient must be moved onto the transfer sheet to move the patient from a bed to the cart. There is nothing to support the patient on the transfer sheet.

U.S. Pat. No. 4,747,170 (Krtouse) reveals an alternative motorized winch type transfer system. The transfer system of the '170 Patent has apparent advantages over the transfer system of the '452 Patent including better gripping of the transfer sheet and the use of a more general type of transfer sheet. The gripping system for the transfer sheet, though, is difficult and awkward to use.

U.S. Pat. No. 5,038,424 (Carter et al.) depicts a system that can transfer a patient from a bed to a cart and from a cart to a bed in equivalent fashion. The movement of a roller from the bed to the cart and vice versa extends the transfer sheeting over both surfaces or over a single surface as desired. Drive motors are located on both the bed and cart to rotate the appropriate roller to move the patient onto the desired surface. While the movable roller provides the convenience of being able to transfer the patient in either direction, it is very awkward in practice to transfer the roller from one position to another while rolling up the loose sheet straight on the roller such that it can be reattached.

Therefore, while considerable effort has gone into producing horizontal patient transfer systems, all of the systems previously developed have significant drawbacks. These drawbacks relate, primarily, to the significant difficulties of the health care worker in operating the system.

The patents described above relate to horizontal transfer systems. U.S. Pat. Nos. 4,700,415 and 4,837,873 (both to DiMatteo et al.) describe a system for transferring a patient onto a cart surface that converts into a chair position. The bed and the cart have independent conveyor systems, so the patient is moved by one conveyor to the edge of the surface where the next conveyor should take over. This system has the obvious problem of needing assistance to move the patient from one conveyor to the other.

The conveyor system on the cart is constructed in sections to allow for folding of the apparatus into a seated position. A motor connected to a worm gear is used to raise and lower the upper and lower portions respectively to form the chair from the horizontal support. The reverse motion converts the chair form into a horizontal support. The sectioning of the conveyor system on the cart/chair has the obvious potential problems of not supporting the patient at the gaps, and risks associated with catching clothing or limbs under the edge of the conveyor at the gaps.

U.S. Pat. No. 3,597,774 (Warren) describes a harness and winch mechanism for pulling up a patient within a bed. The winch is mounted on a post attached to the head of the bed and is operated by a hand crank. The harness fits under the patient's arms so that the patient is pulled under their arm pits. The attachment of the harness provides excessive stress on the shoulders of the patient.

SUMMARY OF THE INVENTION

The present invention includes several novel devices for transferring patients. The devices are greatly simplified and provide enhanced versatility over any known related device. The adoption of these transfer devices will likely reduce the wide incidence of back injuries in health care workers. The first system for the horizontal transfer of patients is adapted to use existing transfer sheets and an appropriately modified cart. The sheet is attached to a clamping device that has a releasable catch which holds the sheet in a cavity. A plurality of straps are attached to the clamping device. The other ends of the straps are attached to reels that are part of a winch. Activation of the winch winds the straps onto the reels.

If the patient is resting on a bed or cart, the winch apparatus will be located on the far side of an adjacent bed or cart. The straps will initially go across the second bed or cart such that when the winch is activated the reeling up of the straps will slide the patient from the first bed or cart to the second bed or cart.

In a highly portable version of this transfer device, the winch apparatus is contained in the same housing as a clamping device for gripping the transfer sheet. The winch has a spool, and a strap is attached to the spool. Rotation of the spool winds or unwinds the strap. The free end of the strap has a fastener for attachment to a clamp fixed at the edge of a bed or cart. When the strap is attached to the clamp and the damping device is gripping a sheet under the patient, winding of the strap moves the patient toward the clamp. So if the patient is initially on an adjacent cart or bed, the patient is transferred to the cart or bed having the damp at its edge.

A long narrow rectangular cushion can be placed between the bed and cart when using the portable transfer device or other horizontal transfer methods. The cushion is approximately the length of the bed. The cushion is optimally covered with a low friction surface. The cushion can have fasteners for attachment of the cushion to a bed or cart. The cushion may also be configured to hang from the side of the bed or cart by the fasteners when the cushion is not in use. The cushion can be used with any horizontal transfer system including the conventional manual system, but the cushion is particularly convenient when used with the portable transfer device of the present invention because no other modifications to the bed or cart are needed.

Other embodiments of horizontal transfer devices facilitate the transfer of the patient by providing some lift to the patient as well as horizontal motion. The vertical and horizontal transfer mechanisms are both operably attached to a single bed or cart frame. The vertical lifting device includes an attachment apparatus for clamping a transfer sheet near the head and foot of the sheet. A slidable horizontal support can shift the attachment apparatus from over a first bed or cart to over a second bed or cart. By performing the lifting and transfer steps in the proper order the patient can be transferred from the first bed or cart to the second bed or cart or vice versa.

One embodiment of a horizontal transfer mechanism within the invention has a transfer element that moves within tracks. Both horizontal supports have corresponding tracks that are aligned to have the transfer element move between the two horizontal supports. The transfer element has a clamping device for attachment of a transfer sheet. A docking mechanism connects one of the horizontal supports to the transfer element. The docking mechanism has a docking support that is attached to a drive mechanism. When the docking mechanism is attached to the transfer element, the drive moves the transfer element within the tracks and between the two horizontal supports. By moving between the tracks of the bed and cart, the transfer element moves the patient between the bed and cart.

A horizontal transfer system of the invention moves the patient on a modularized cushion. The modularized cushion has a plurality of grips. A horizontal slide has releasable clamps to engage the grips. A drive mechanism moves the horizontal slide to provide reversible motion of the modularized cushion. In this way the modularized cushion can be moved between a first horizontal support surface and a second horizontal support surface.

A harness within the invention has the significant advantage of distributing the weight of the patient without the need to lift the patient to place a portion of the harness under the patient. The harness has a support that goes across the patient's upper body. Another portion of the harness goes under the patient's arms. The harness has a fastener that attaches a lift mechanism near the back of the patient's head.

A harness winch combination provides a winch within the padded portion of the harness. The harness has a padded support. Preferably, a motorized winch includes a reel, and a line is attached to the reel. The free end of the line has a fastener to attach the line appropriately depending on the desired motion of the patient. The controls for the motorized embodiment of the winch can be located on the harness so that the health care worker can stay at the patient's side while moving the patient. Alternatively, the controls can be located on a hand control unit or on the bed.

A patient transport system includes a plurality of ceiling mounted winches. Each winch has a line with a fastener at the end. The line is connected to a controller which provides instruction to the winches based on an instruction to move the patient in a particular way.

BRIEF DESCRIPTION OF THE DRAWINGS

FIG. 17 is a perspective view of the further embodiment of the horizontal transfer system with an alternative design for the horizontal drive;

FIG. 20*a* is a partial perspective view of one end of the embodiment of FIG. 17 with an arrow showing the disengagement of a removable panel;

FIG. 20*b* is a partial perspective view of one end of the embodiment of FIG. 17 with a removable panel attached as a shelf;

FIG. 24 is perspective view of an alternative embodiment of the horizontal transfer system;

FIG. 25 is a perspective view of a portion of the alternative embodiment of FIG. 24 showing extendable horizontal supports;

FIG. 3*b* is a side view of the transfer bridge in the raised position with lever and rods removed;

FIG. 41 is a perspective view of the mattress transfer system and position changing cart depicting the cart in a folded position;

FIG. 42 is a side view of the position changing cart in the chair orientation;

FIG. 43*a* is a perspective view of a lobster claw type of bed jacket being placed on one side of a person;

FIG. 43*b* is a perspective view of the bed jacket in place around a person;

FIG. 43*c* is a perspective view of the bed jacket secured around a person and hooked to a hoisting mechanism;

These figures are intended to be merely illustrative and non-limiting.

DETAILED DESCRIPTION OF THE INVENTION

The invention includes improved devices and methods for moving patients and other individuals who lack full mobility. Patients must be moved in a variety of ways while providing care at hospitals, at nursing homes and in home care programs. For example, patients may need to be transferred essentially horizontally from a bed to a cart or vice versa, they may need to be repositioned in a bed or chair, or they may need to go between a prone and a sitting or standing position. The unifying feature of the various embodiments of this invention is that they generally empower a single health care worker to move a patient substantially without any risk of injury to either the patient or the health care worker.

The common features of the horizontal transfer systems of the invention include a support under the patient and a mechanical or electromechanical system for applying horizontal force to the support to cause the transfer. The designs of the particular embodiments incorporate varying designs while building on the common conceptual foundation. In order to reduce cost, the simplest systems are designed to be adapted for use with beds, carts and transfer sheets already commonly found in most health care facilities. Other embodiments optimize the particular characteristics of the design with less regard to adaptation to existing equipment. In all cases, the designs remain true to the goal of the safe transfer of a patient by a single health care worker.

Figure 1:
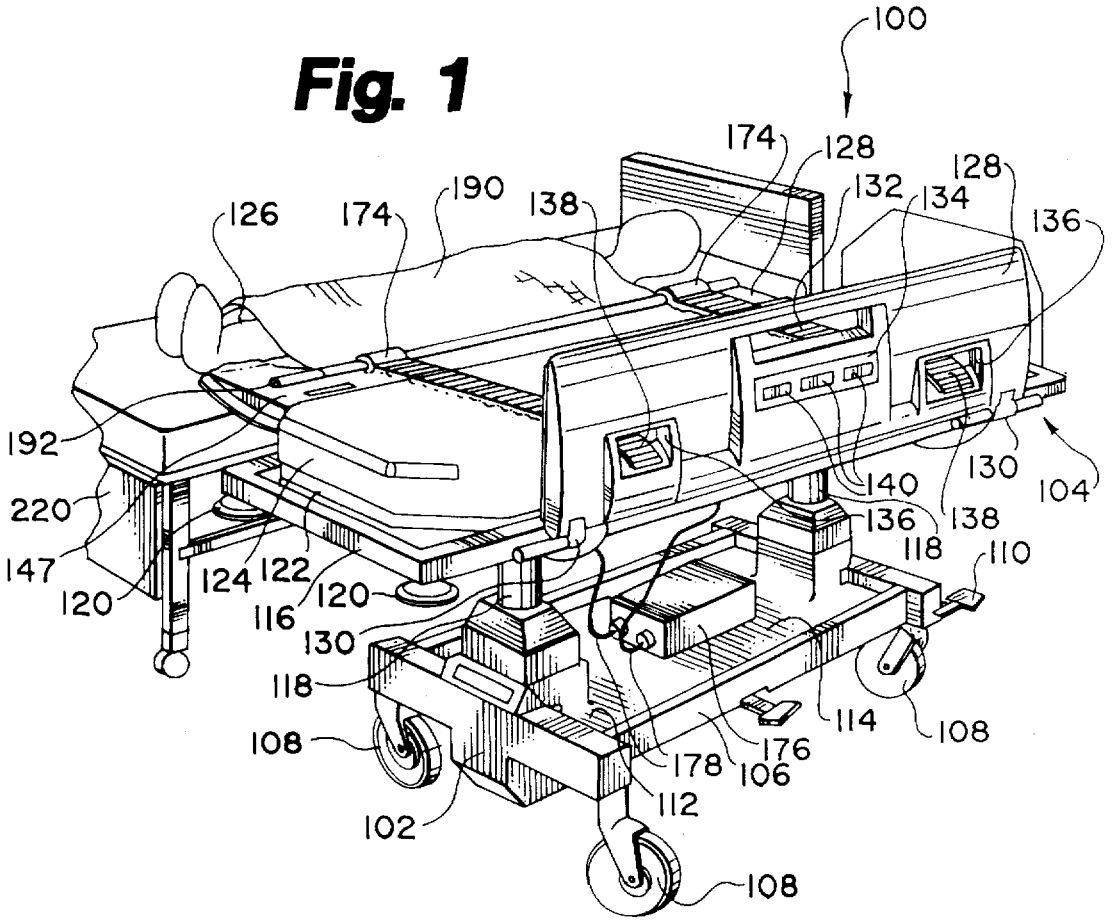
FIG. 1 is a perspective view of a bed with an adjacent cart adapted with a first embodiment of a horizontal patient transfer system.

Referring to FIG. 1, the first embodiment of the horizontal transfer system 100 includes a standard patient cart 102 retro fitted with a horizontal transfer mechanism 104. The cart 102 will generally have a base 106 with four wheels 108. The wheels 108 preferably have lock levers 110 for applying brakes that prevent the rotation of the wheels 108. The base 106 may have a top surface 112 that usually, but not necessarily, will have a flat portion 114.

The cart 102 has a support portion 116. The support portion 116 is attached to the base by one or more upright supports 118. The embodiment represented in FIG. 1 has two upright supports 118. Some designs may have the wheels 108 attached directly to the upright supports 118 eliminating the need for a base 106. The support portion will preferably have cushioned bumpers 120. The cart 102 can have the capability of raising and lowering the support portion 116 relative to the base 106 and other features. The support portion 116 provides a support structure 122 for supporting a cushion or mattress 124 for holding a patient 126.

Figure 2A:
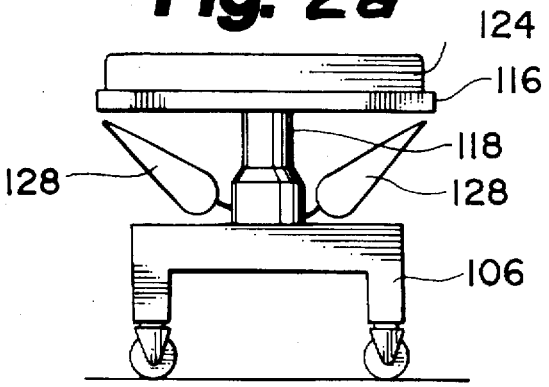
FIG. 2*a* is a front, schematic view of a cart adapted with the first embodiment of a horizontal patient transfer system with side rails in a lowered storage position.
Figure 2B:
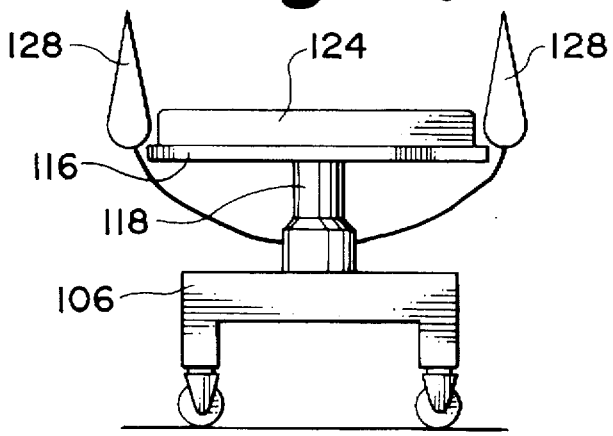
FIG. 2*b* is a front, schematic view of a cart adapted with the first embodiment of a horizontal patient transfer system with side rails in a raised patient transport position.
Figure 2C:
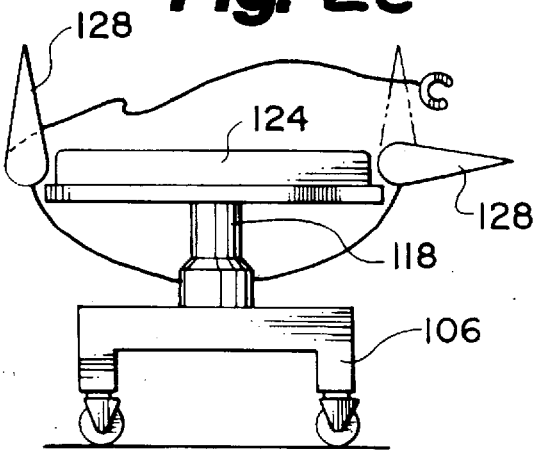
FIG. 2*c* is a front, schematic view of a cart adapted with the first embodiment of a horizontal patient transfer system with one side rail in a raised position and a second side rail in a bridge position used during patient transfer.
Figure 2D:
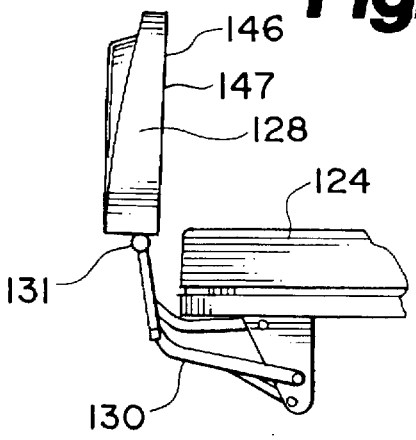
FIG. 2*d* is a front fragmentary view of one embodiment of hinges supporting a side rail.

The horizontal transfer mechanism 104 includes two side rails 128. Referring to FIG. 2*d*, the side rails are mounted to the cart 102 with hinges 130 and 131. The side rails 128 and hinges 130 are preferably adapted from existing side rails and hinges on the cart 102. The hinges 130 can adjust to place the side rails 128 in either an elevated pull position or a lowered storage position. Preferably, hinges 131 are used to place the side rails 128 in a horizontal bridge position to provide support and a smooth surface for transferring the patient. The different positions are schematically depicted in FIGS. 2*a–c*. Alternative designs for the side rail can allow for the side rail to slide straight down to a lowered position, and other variations are possible.

Each side rail 128 has a handle 132, a control panel 134 and two openings 136 for a power assembly, such as winch 138. Other numbers of openings can be used for access to the winch unit. The control panel 134 has a plurality of switches 140 to control the operation of the winch 138. The particular design of the side rail 128 and control panel 134 can be varied without effecting their function.

Figure 3A:
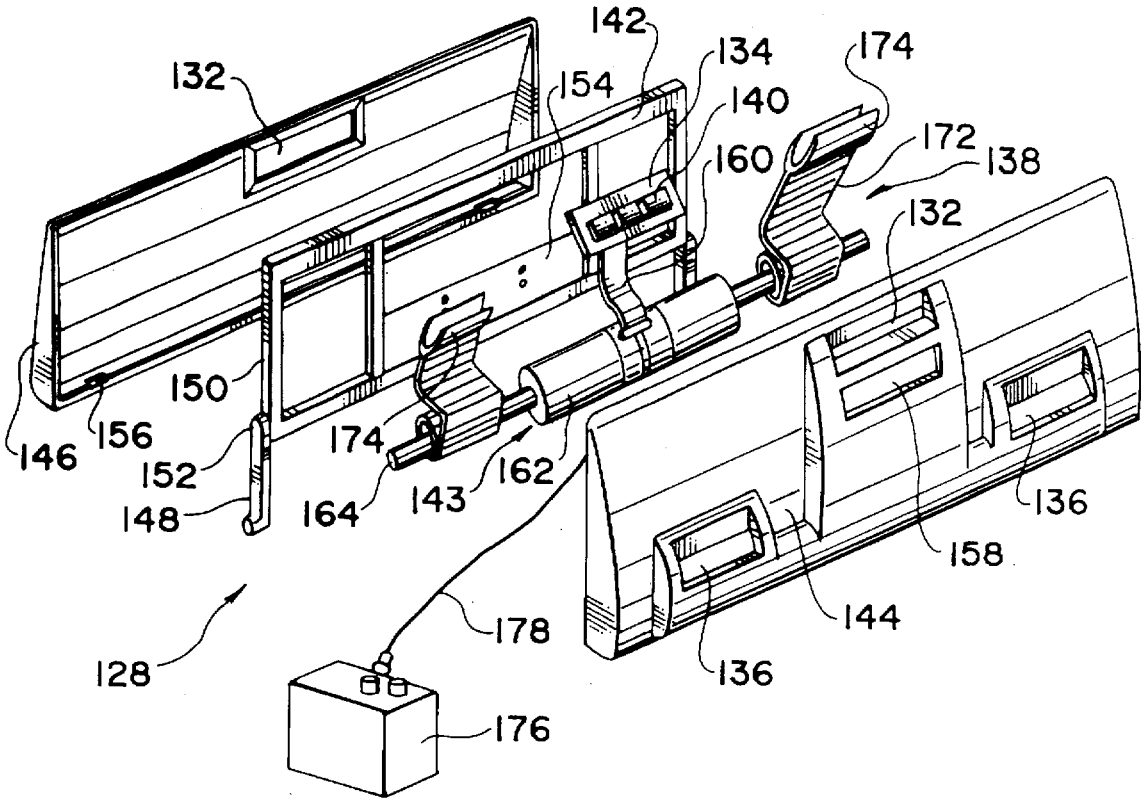
FIG. 3*a* is an exploded view of a side rail of the first embodiment of a horizontal transfer system.

Referring to FIG. 3*a*, a convenient structure for the side rail 128 has a frame 142, winch 138, a front cover 144 and a back cover 146. The frame 142 has extensions 148 attached to frame substructure 150 at frame hinge 152. The frame substructure 150 has a winch mounting portion 154. The frame substructure 150 is preferably made from metal, a rigid polymer or a composite material, although other materials exhibiting the proper strength, weight, and cost characteristics may be suitable. The back cover 146 has open portions 156 for the passage of extensions 148 and motion of frame hinges 152 as well as a portion of handle 132. The outer surface 147 of back cover 146 (FIG. 2*d*) is a transfer surface that preferably is made from a very low friction material to assist with the transfer process and reduce the risk of injury. Front cover 144 has parts of handle 132 and openings 136, and control panel opening 158.

Figure 3B:
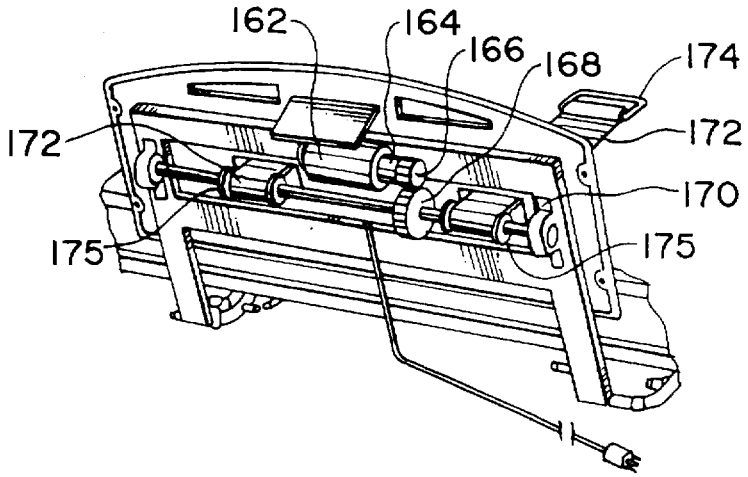
FIG. 3*b* is a cut away view of a second drive system within the side rail.
Figure 4:
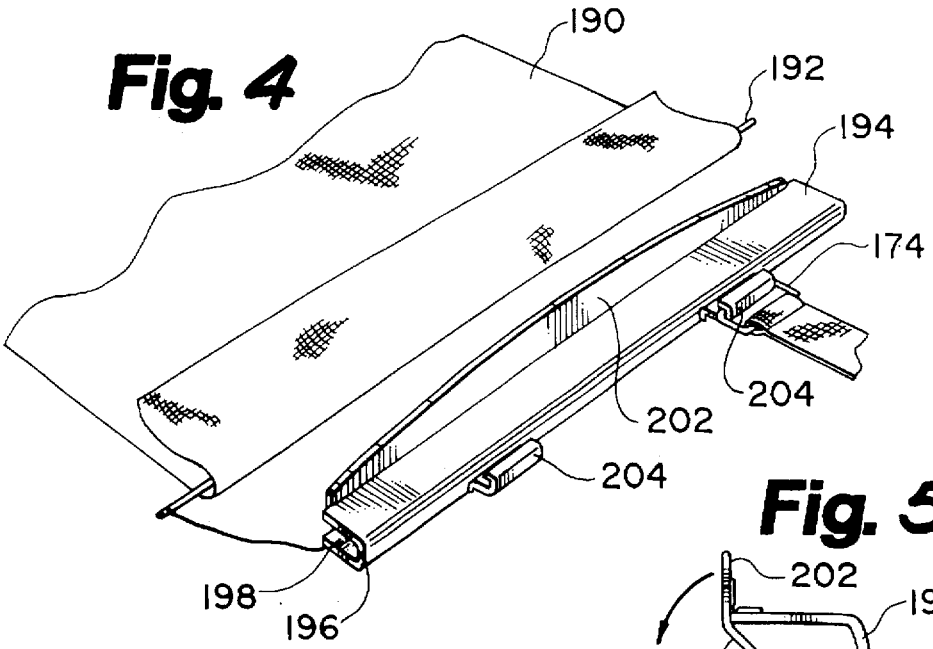
FIG. 4 is a perspective view of a first embodiment of a clamping device useful with a first embodiment of the horizontal transfer system in an orientation to be clamped to a transfer sheet folded over a rod.
Figure 5:
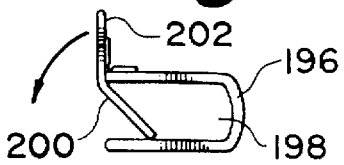
FIG. 5 is an end view of a first embodiment of the clamping device.
Figure 6:
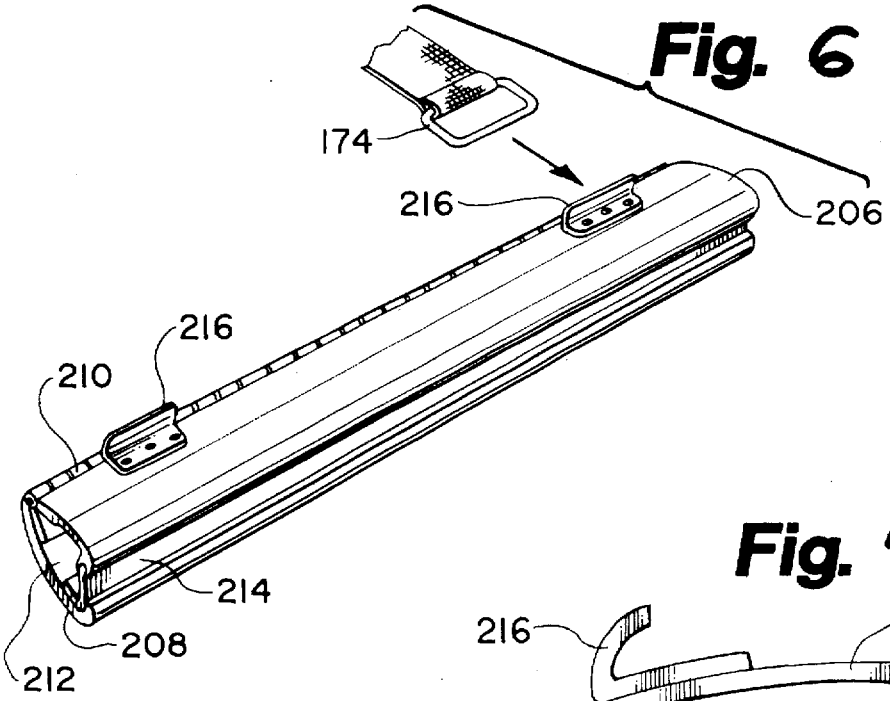
FIG. 6 is a perspective view of a second embodiment of the clamping device.
Figure 7:
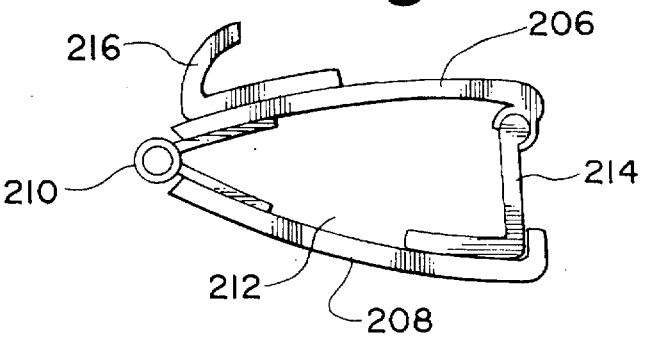
FIG. 7 is an end view of the second embodiment of the clamping device.
Figure 8:
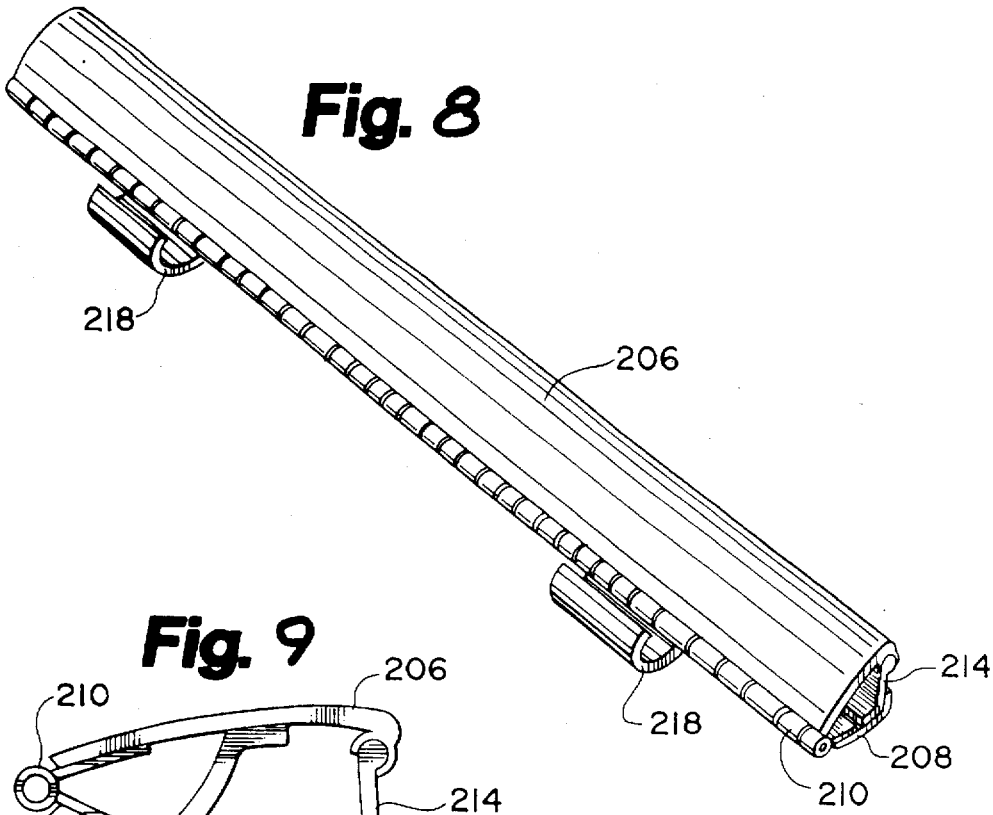
FIG. 8 is a perspective view of a third embodiment of the clamping device.
Figure 9:
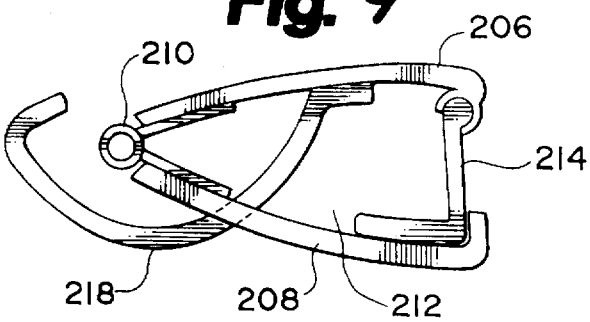
FIG. 9 is an end view of the third embodiment of the clamping device.

The winch 138 is coupled to control panel 134 by wires 160. A conventional manual winch can also be used without excess difficulty, but less conveniently. The drive system 143 preferably has at least one motor 162 and can use a variety of conventional designs. The motor may directly rotate the drive shaft as depicted in FIG. 3*a*. Referring to FIG. 3*b*, the motor 162 rotates a first drive shaft 164 which has a first gear 166. First gear 166 engages a second gear 168 which preferably has a larger diameter than first gear 166 so that the rotation of the motor 162 is reduced. Second gear 168 is connected to a second drive shaft 170.

Two belts 172 each with a clip 174 are attached to the second drive shaft 170 at positions aligned with openings 136. The belt preferably winds on spools 175 which help ensure that the belts 172 wind and unwind straight. The belts 172 are preferably made from very strong synthetic fabric such as the material used in seat belts for automobiles. The winch 138 can be powered by a battery pack 176 utilizing power cord 178. Alternatively, winch 138 can be powered by alternating current using a power cord (not shown).

Cart 102 of FIG. 1 is designed for use with a standard patient draw sheet 190. The standard patient draw sheet 190 is wide so that it can be folded over the patient 126, if desired, but typically not long enough so that it rests under the head or feet of the patient. Rather than using several people to move the patient with the draw sheet 190, horizontal transfer mechanism 104 performs the comparable function. Clips 174 can be designed to attach directly to draw sheet 190, but it is preferred to use clamping device 194 to provide a more even pull over the length of the sheet 190 and smoother motion to the patient. For particularly tall patients, the draw sheet 190 can be wrapped around patient 126 for added support of the patient, and both ends of the sheet are attached to clamping device 194.

Three embodiments of the clamping device 194 are presented in FIGS. 4–9. In the first embodiment shown in FIGS. 4 and 5, clamping device 194 can be used to attach draw sheet 190 to winch 138 employing rod 192. A U-shaped portion 196 forms a cavity 198 which is covered by a spring loaded gate 200. Rod 192 can enter the cavity 198 when pushed against the gate 200. Force from the rod 192 against the gate 200 from inside the cavity 198 tends to force the gate 200 closed thereby preventing the withdrawal of the rod 192. Gate 200 has an upward extension 202. Forward force on the upward extension 202 opens the gate 200 for the withdrawal of rod 192 from cavity 198. Clips 174 are conveniently attached to the clamping device 194 at J-shaped flanges 204. Rod 192 can be optionally tethered to the clamping device 194 at one or more positions for convenience, and the rod 192 can be clipped to the clamping device 194 for storage.

In the second and third embodiments, the clamping device 194 has an upper portion 206 and a lower portion 208 attached at a hinge 210 to form a cavity 212. The front of the cavity 212 is closed by an L-shaped, hinged closure 214. The two embodiments differ in their design of J-shaped flanges 216 or 218 for the attachment of clips 174. In these two embodiments, the sheet 190 is directly placed into the cavity 212 without the need to wrap the sheet 190 around a rod 192, although a rod 192 could still be used if desired. The sheet is held in place by the L-shaped hinge closure. A thin rigid tucking device (not shown) of any convenient length can be used if desired to assist with tucking the sheet into the clamp.

Clearly, a variety of other designs for clamping device 194 are possible within the general concepts presented. For all of these embodiments, any portion of the sheet can be attached, not just the end of the sheet. This is important because the clamping device should be placed near the patient so that the transfer mechanism 104 can fully transfer the patient onto the second horizontal surface from the first.

In operation, the cart 102 is wheeled up to a patient's bed 220, as depicted in FIG. 1, or another cart. The side rail 128 facing the patient's bed 220 is placed in the bridge position with the low friction surface 147 directed upward. The draw sheet 190 is attached to a clamping device. The belts 172 are unwound from drive shafts 164 so that they are long enough to reach rod 192 at the edge of the bed 220. The belts are unwound either by activating the motor to unwind the belts or by using a clutch to allow the belts to be freely withdrawn from the drive shaft. The clips 174 on the ends of the belts 172 are attached to a clamping device 194 and the clamping device 194 is engaged by the rod 192 and sheet 190. Other embodiments of the damping device can be used with or without the rod 192.

The appropriate switch 140 is engaged, and the winch 138 begins winding the belts 172 onto the drive shafts 164. The motor 162 should be designed to apply a slow, steady and constant force to move the patient 126 without jerking or applying any other inappropriate forces. The draw sheet 190 helps to distribute the forces over significant areas of the patient's body. When the patient 126 is on the cart's cushion 124, the motor 162 is turned off. At this point, the belts 172 are disconnected from the clamping device 194, and the sheet 190 is removed from the clamping device.

In order to transfer a patient from a cart to a bed, the bed would have to be adapted with a similar winch as described on cart 102. This bed based transfer device would preferably be adapted with the side rails of a conventional bed. These side rails may go up and down rather than folding under the bed. The winch could easily be adapted on one or both sides of the bed. It would be straightforward to retrofit a bed in a comparable fashion as a cart, based on the above description.

Figure 10:
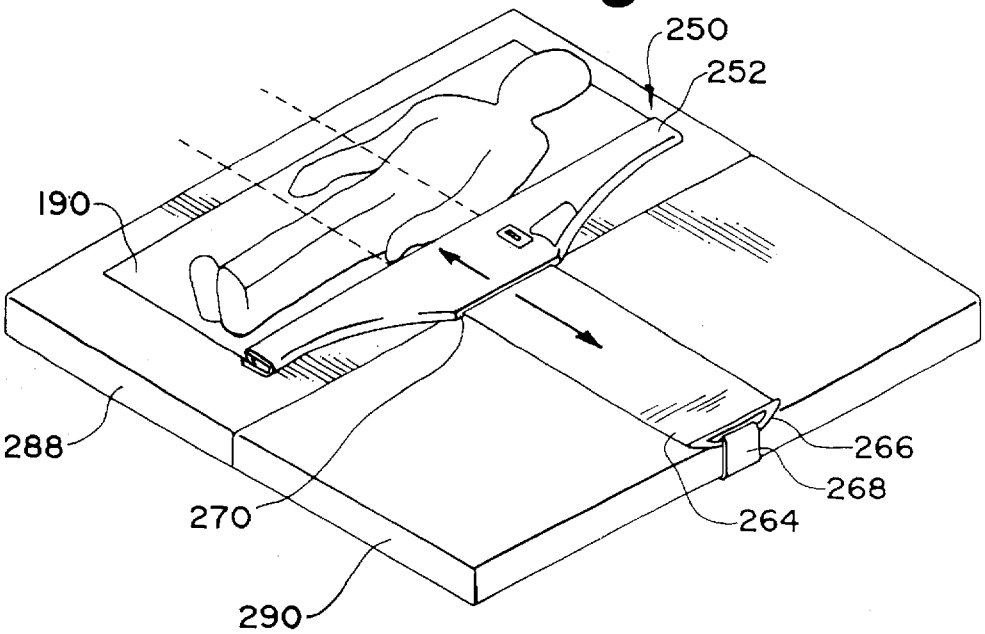
FIG. 10 is a perspective view of the attachment of a portable horizontal transfer device for the transfer of a patient from one horizontal surface to another.
Figure 11:
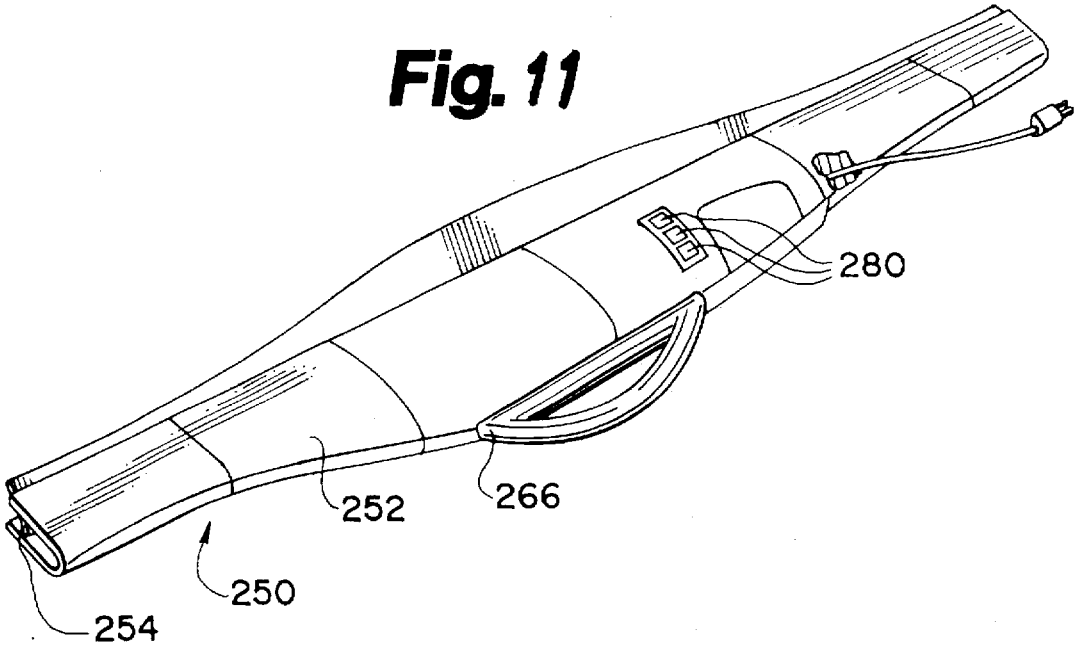
FIG. 11 is a perspective view of the portable horizontal transfer device.
Figure 12:
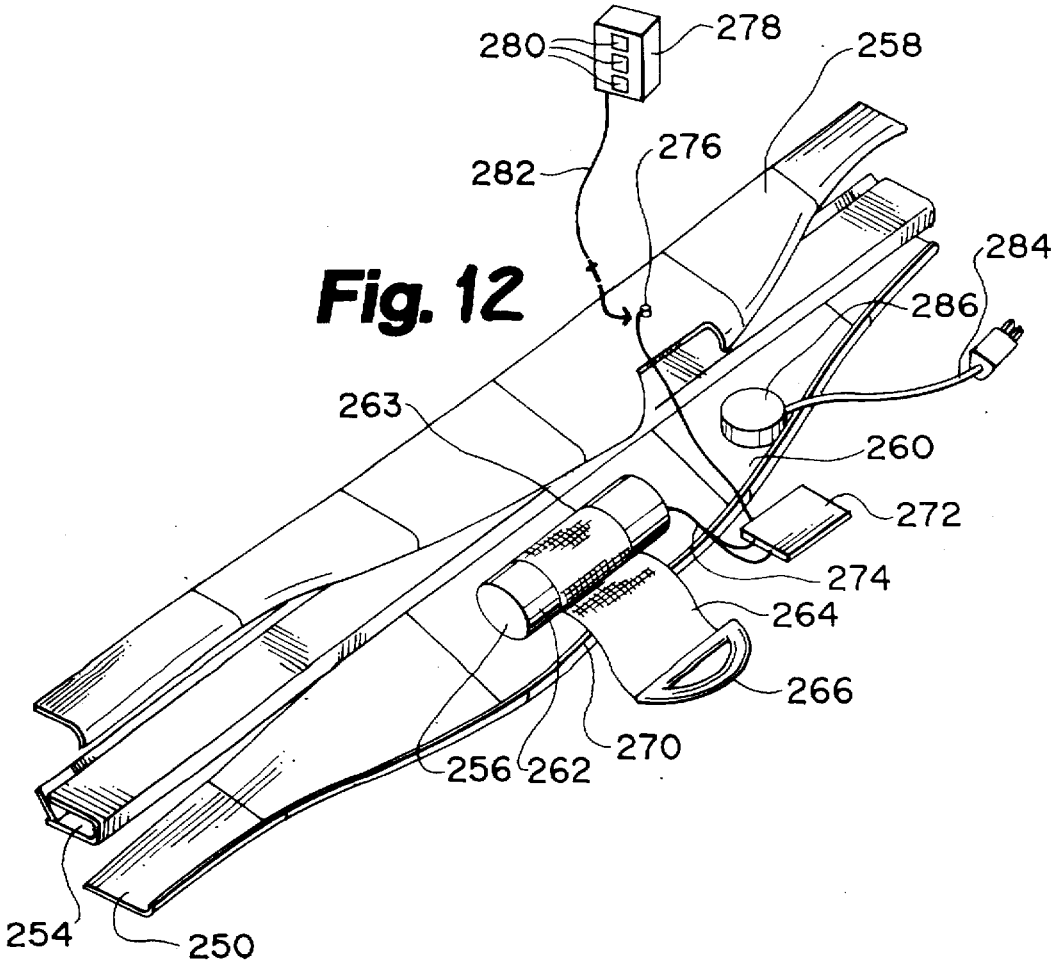
FIG. 12 is an exploded view of the portable horizontal transfer device.

Alternatively, a portable win& unit readily carried by a single health care provider can be used to replace the winch on the bed, on the cart or both. One embodiment of such a portable winch unit 250 is shown in FIGS. 10–12. The portable winch unit 250 includes a housing 252, a clamping device 254 and a winch 256. The clamping device 254 serves to hold a transfer sheet 190 in the same way as clamping device 194 in the first embodiment of the horizontal transfer device 100. The clamping device 254 also serves as a frame or a portion of the frame for the portable winch unit 250. The housing 252 preferably has a top portion 258 and a bottom portion 260 which are preferably heavy plastic shells surrounding the clamping device 254 and the winch 256, although other materials can be used.

The winch 256 includes a motor 262 that can rotate a drive shaft (not shown) connected to a reel 263. Belt 264 winds around reel 263. Belt 264 is comparable to belts 172 in embodiment 100. The free end of the belt 264 has a handle 266. Handle 266 attaches to a clamp 268 rigidly attached to the edge of a bed or cart. The clamp 268 can be designed to fold out of the way when not in use. The belt 264 passes out of housing 252 through an opening 270. The operation of winch 256 can be controlled through a circuit board 272 which is connected to motor 262 by wire 274. Circuit board 272 can be similarly connected to a port 276.

A control unit 278 with switches 280 can be connected to port 276 by way of tether 282. The operator can operate the winch 256 using control unit 278. Alternatively, control switches 280 can be made integral with the housing 252, as shown in FIG. 11, but this would be less desirable because the operator would have to lean over the bed or cart while the patient was being transferred. Control unit 278 can have a wireless connection with circuit board 272 using a transmitter/receiver (not shown). Winch 256 is powered by a standard wall outlet using a cord 284. A retractable cord assembly 286 is preferably used to keep the cord out of the way when not in use and to prevent excess cord being in the way during the transfer of the patient. Alternatively, a battery, preferably rechargeable, can be used to power the winch.

Figure 13:
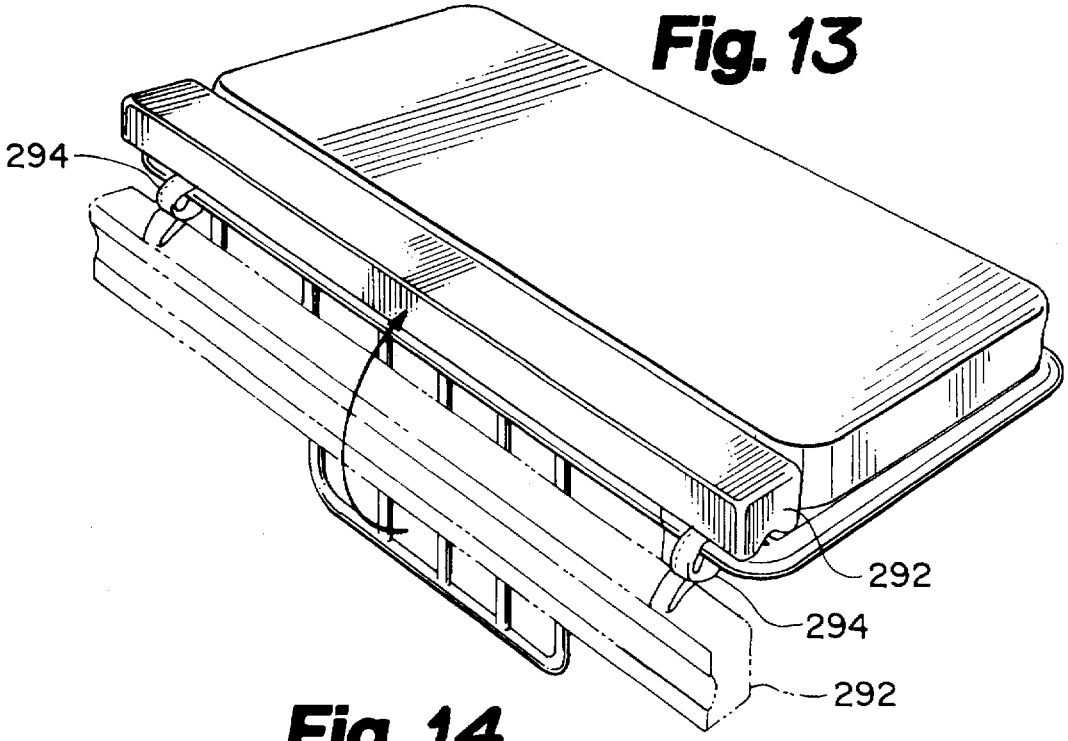
FIG. 13 is a perspective view of a portable cushion attached to a horizontal surface to provide a smooth continuous surface for the transfer of a patient with the portable horizontal transfer system, with the cushion in a lowered, stored position shown in phantom lines.

Referring to FIG. 10, to transfer a patient from a first bed/cart 288 to a second bed/cart 290, a draw sheet 190 is used under the patient in the same way as in the first embodiment 100. A portable cushion 292 can be placed between the first bed/cart 288 and the second bed/cart 290 to provide a relatively smooth continuous surface for transferring the patient, as shown in FIG. 13. Straps 294 with a hook and loop fastener can be used to attach the portable cushion 292 to the bed or cart when not in use. The portable cushion 292 can be used with other transfer devices or even as an aid during manual transfer. The cushion 292 would preferably have a top surface with a very low friction which is preferably made from a plastic material.

The portable winch unit 250 is attached to draw sheet 190 using clamping device 254, as shown in FIGS. 11 and 12. The design of the clamping device 254 can be similar to the clamping devices in FIGS. 4–9 or a comparable design based on similar concepts. The draw sheet 190 can be wrapped over a rod 192 (FIG. 4) for attachment to the clamping device 254. Referring to FIG. 10, belt 264 is withdrawn from housing 252 so that handle 266 can be attached to clamp 268. Clamp 268 is rigidly attached to the second bed/cart 290 on its side opposite the side near the first bed/cart 288. Clamp 268 can be optionally reversibly detachable or lowerable to storage position. The operator uses control unit 278 to activate the motor 262. As the motor 262 retracts belt 264, the portable winch unit 250 and the patient are drawn toward clamp 268 which result in the patient being moved onto second bed/cart 290.

Figure 14:
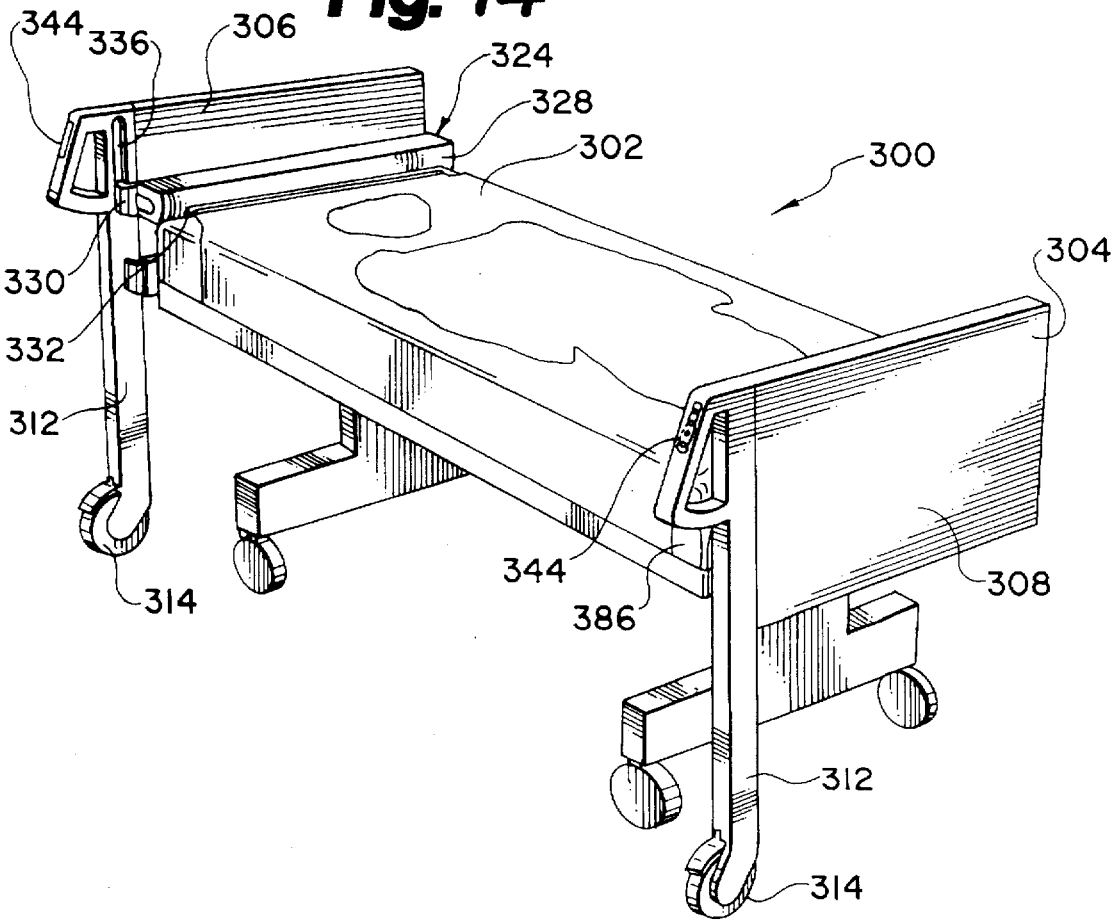
FIG. 14 is a perspective view of a further embodiment of a horizontal transfer system.

A further embodiment of a horizontal transfer system 300 involves a specially designed transfer sheet 302 and a transfer unit 304, as shown in FIG. 14. Since the transfer unit 304 can move a patient in either of two directions, horizontal transfer system 300 has the advantage that only either the cart or the bed must be supplied with a transfer unit 304, not both. Therefore, the cart or bed not adapted with the transfer unit 304 can be conventional.

Figure 15:
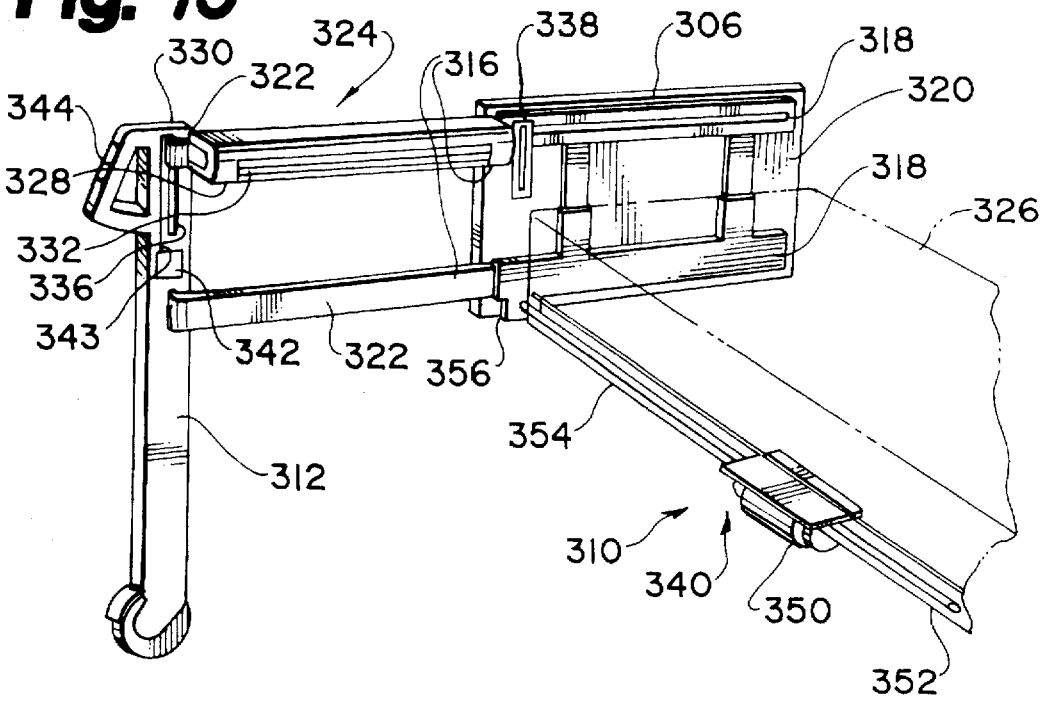
FIG. 15 is a partial, cut away perspective view of the further embodiment of the horizontal transfer system showing the drive system for horizontal extensions.

The transfer unit has a head frame 306 and a foot frame 308 attached to a drive system 310 (FIG. 15). The head frame 306 replaces or attaches to the head board of the bed or cart while foot frame 308 replaces or is attached to the foot board of the bed or cart. The head frame 306 and the foot frame 308 each have at least one vertical support 312 with a wheel 314 at the bottom of the vertical support 312. The wheels 314 should be oriented to roll along the direction defined by the width of the bed/cart. The wheels 314 can be attached to the vertical support 312 in a way that permits shifting of the wheels out of contact with the floor so that the bed or cart can be moved without interference from the wheels 314. The vertical supports 312 can have a removable brace (not shown) extending between the two vertical supports 312 to help compensate for the forces created by the weight of the patient.

Figure 16:
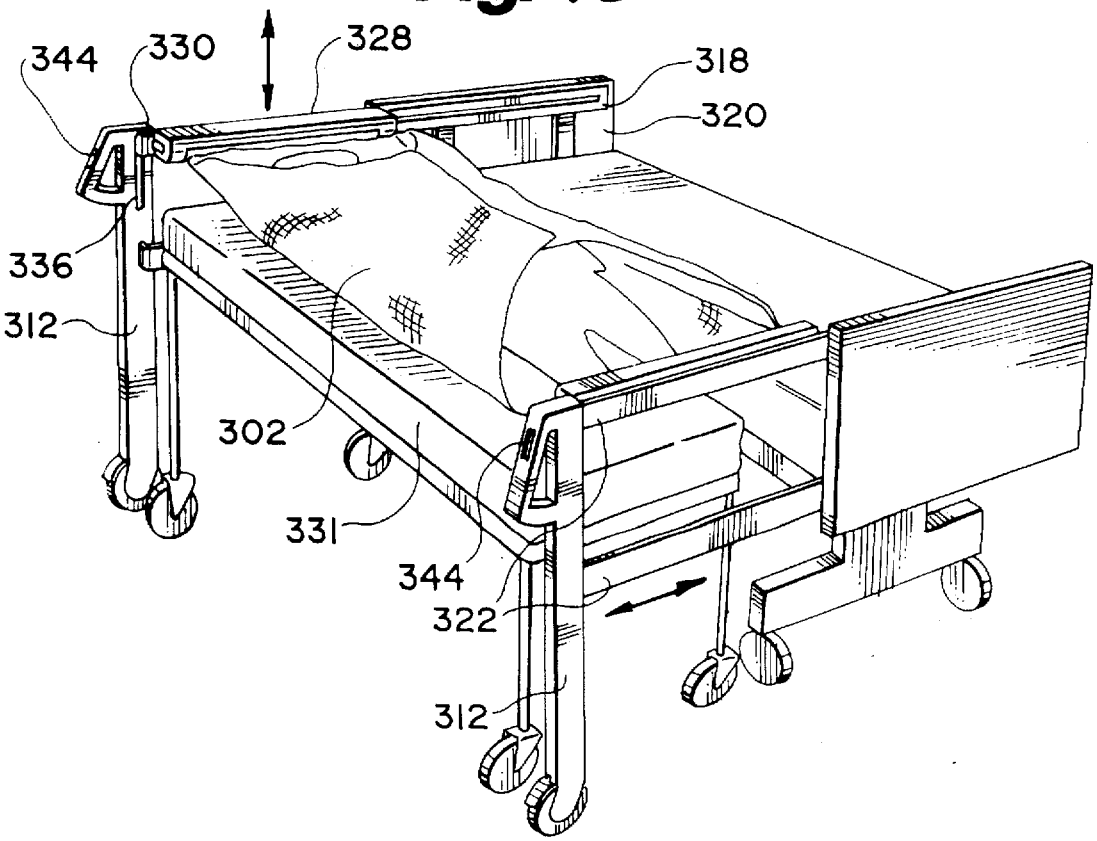
FIG. 16 is a perspective view of the further embodiment of the horizontal transfer system with a patient elevated over a cart to indicate the ranges of motion obtainable by the transfer system.

Referring to FIGS. 15–17, the head frame 306 and foot frame 308 each have at least one expandable horizontal support 316 extending from the vertical supports 312. The expandable horizontal supports 316 have fixed portions 318 that are attached to the head(foot) board or the head(foot) board portion 320 of the head(foot) frame 306 (308). Fixed portions 318 of the expandable horizontal support 316 typically would extend at least across the width of the bed or cart. Telescoping portions 322 of expandable horizontal support 316 are attached to a vertical support 312 and slidably engage a corresponding fixed portion 318. Typically, the telescoping portion 322 will slide into the corresponding fixed portion 318, although other types of slidable engagement are possible.

Figure 19:
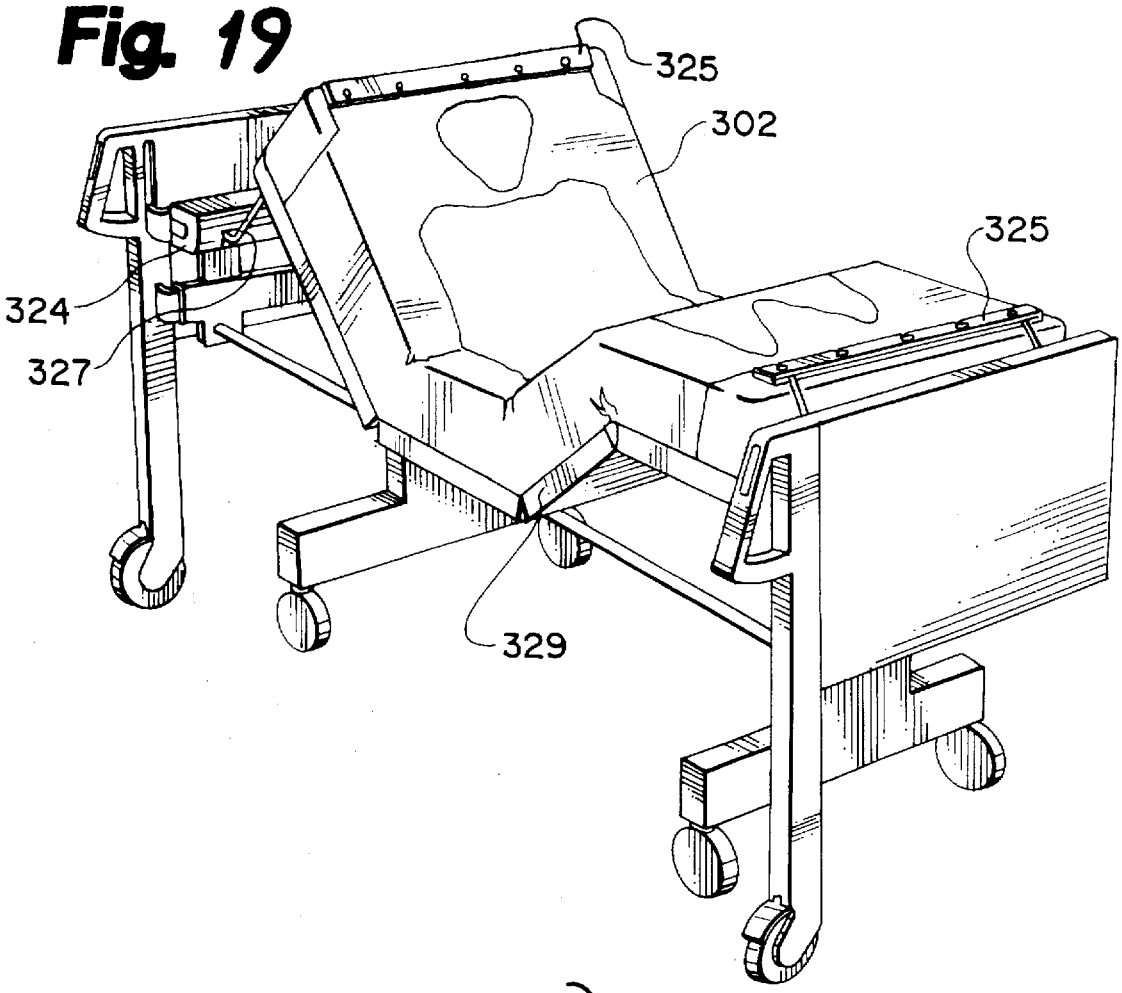
FIG. 19 is a perspective view of a bed equipped with the further embodiment of the horizontal transfer device with the bed in a raised position.
Figure 18:
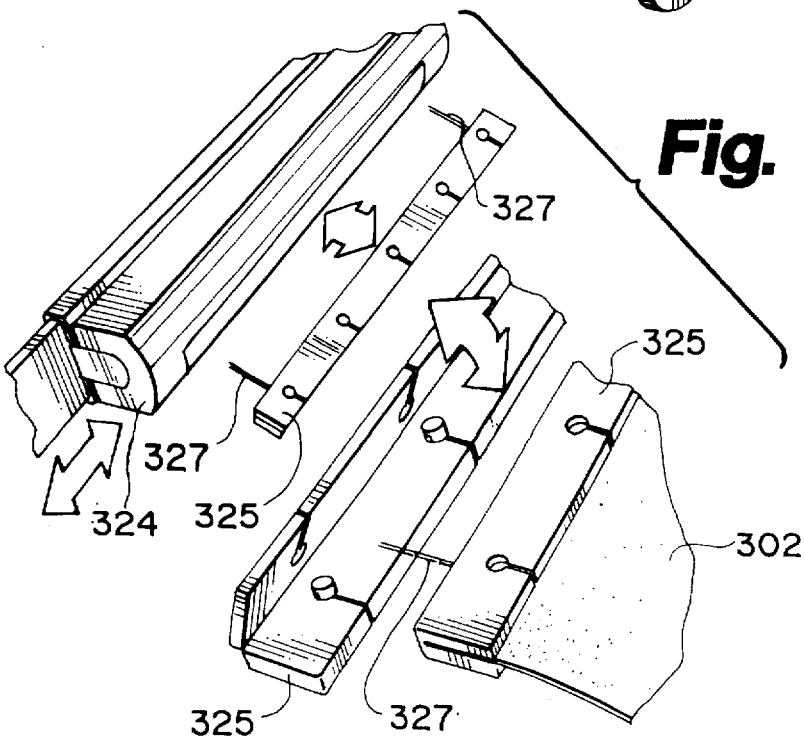
FIG. 18 is a fragmentary perspective view of a sheet clamp indicating its motion relative to a lifting support and its attachment to a transfer sheet.

The head frame 306 and the foot frame 308 each have a lifting support 24. The lifting support 324 is attached in a way such that it moves with the vertical support 312 and the telescoping portions 322. Each lifting support 324 has a gripping portion 328 and generally two lifting portions 330. The gripping portion 328 has an opening 332 into which sheet clamp 325 can be withdrawn using cables 327, as shown in FIG. 18. Sheet clamp 325 can grasp transfer sheet 302. Referring to FIG. 19, cables 327 permit sheet clamps 325 to remain attached to transfer sheet 302 while the mattress support 329 goes through a range of motion. In a preferred configuration, one lifting portion 330 engages vertical support 312 at a slot 336. Another lifting portion 330 engages moving support 338 which is attached to a telescoping portion 322.

The lifting support 324 is capable of a range of vertical motion. The range of vertical motion will typically be between 6 inches and 12 inches. The range of vertical motion gives enough clearance for the horizontal transfer from a first bed/cart to a second bed/cart. In other words, the retrofitted bed/cart 326 with its attached transfer unit 304 can transfer patients from or to the retrofitted bed/cart 326. The vertical lift is also convenient for the changing of linens, although the transfer sheet would need to be changed separately.

Figure 21:
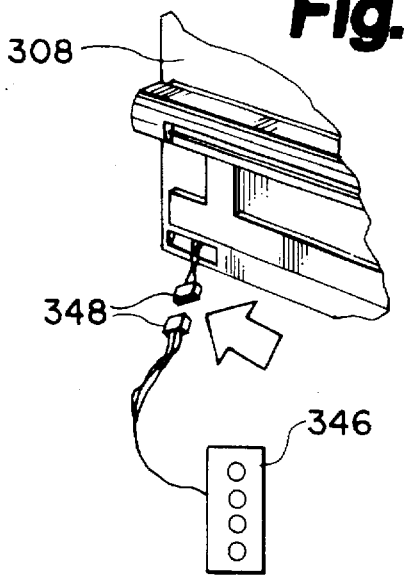
FIG. 21 is a perspective view of a portion of the foot board bed or cart adapted with the further embodiment of the horizontal transfer system indicating a location for the attachment of a control unit.

Referring to FIG. 15, the drive system 310 includes a horizontal drive system 340 and a vertical drive system 342. The drive system 310 is operated from a control panel 344 (FIGS. 14–16) that is located on vertical supports 312 or a portable controller 346 (FIG. 21) that is patched into the head frame 306 or foot frame 308 through connector 348. Other arrangements for the control of the drive system 310 are possible. The drive 342 for the vertical motion of the lifting support can be adapted to operate by any conventional motor or hydraulic system, such as a motorized worm drive 343.

Two embodiments are shown for horizontal drive system 340 in FIGS. 15 and 17 respectively. The first involves a motor 350 fastened to the bottom of the bed/cart frame 352. The motor turns drive shafts 354 which go to a transmission 356 which transfers the rotation of the drive shaft to lateral motion of a telescoping portion 322 of an expandable horizontal support 316. The second embodiment of the drive system has a motor 358 mounted on either the head frame 306 or the foot frame 308. The motor 358 rotates a worm drive 360 that is mounted horizontally along side of the motor 358. The worm drive 360 transfers motion to a telescoping portion 322 of an expandable horizontal support 316. An optional removable panel 362 can be removed, as shown in FIG. **20*a* and mounted on the foot frame 308 where it can be used as a shelf or cardiopulmonary resuscitation (CPR) board for additional equipment as shown in FIG. 20*b***.

Figure 22:
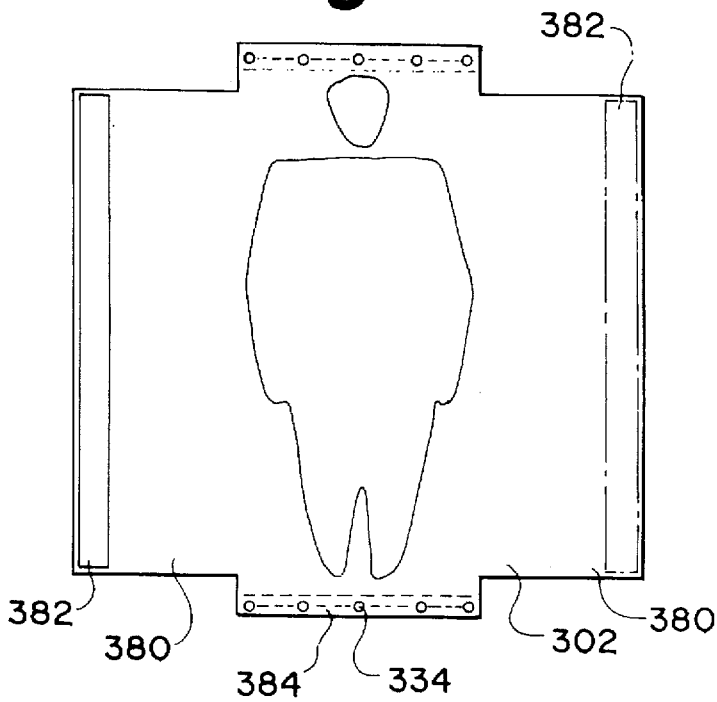
FIG. 22 is a top view of a transfer sheet designed for use with the further embodiment of the horizontal transfer system.
Figure 23:
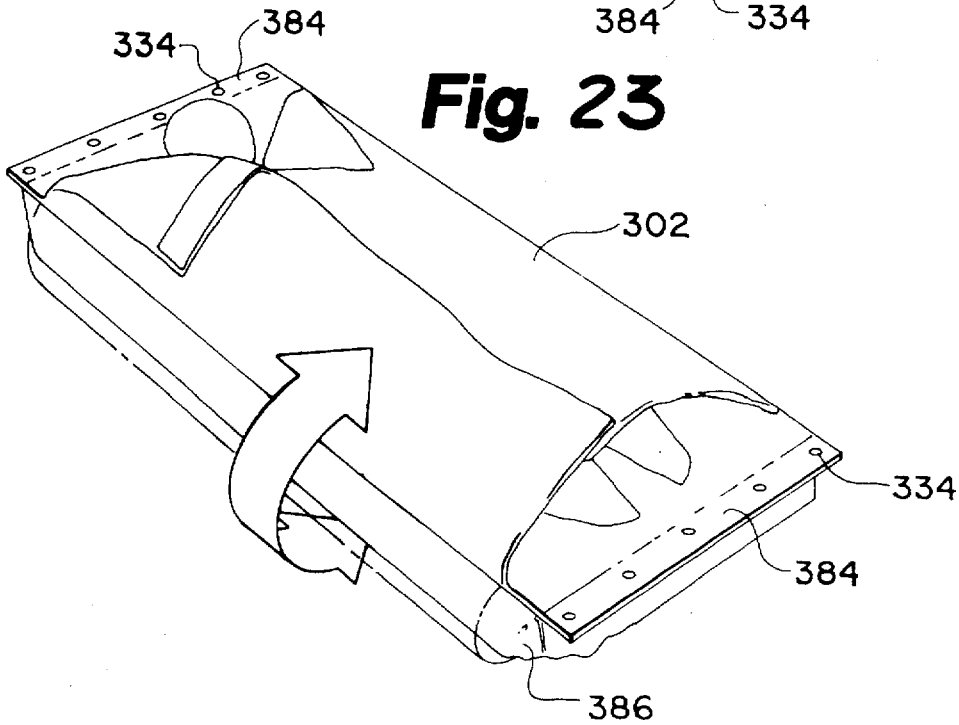
FIG. 23 is a perspective view of the transfer sheet of FIG. 22 shown in its folded position.

An appropriate transfer sheet 302 for use in this embodiment of the horizontal transfer unit 300 is depicted in more detail in FIGS. 22 and 23. The transfer sheet 302 has wings 380 with hook and loop or comparable fasteners 382 at the edges of the wings 380. The wings 380 can be folded over the patient and closed with fasteners 382. The shape of the wings can be selected as desired. The top and bottom of transfer sheet 302 can have reinforced attachment portions 384 optionally with reinforced holes or grommets 334. Alternatively, the sheet can be attached to the sheet clamps 325 similar to the attachment of the sheet to the clamps shown in FIGS. 4–9. Having grommets on the sheet can be a disadvantage during the washing process. The attachment portions 384 will generally extend to or just beyond the end of the mattress 386. Other designs are possible for the sheet, for example a version that does not fold over the patient.

Referring to FIGS. 15 and 16, in operation, the vertical supports 312 and the telescoping portion 322 of horizontal supports 316 are initially placed in their retracted position if the patient is being moved from the retrofitted bed/cart 326 and are initially placed in their extended position if the patient is being moved from a separate bed/cart 331 to the retrofitted bed/cart 326. The transfer sheet 302 is optionally folded over the patient, and the fasteners 382 are secured. Attachment portions 384 are placed into opening 332, and sheet clamps 325 engage reinforced holes 334. At this point, the vertical drive system 342 originally in its lower point is engaged to its upper point to raise the patient into a suspended position.

The horizontal transfer system 300 is engaged accordingly to move the patient from an original location to the transfer location. If the patient was originally on the retrofitted bed/cart 326, the vertical supports 312 and the telescoping portion 322 move to their extended position, and if the patient was not originally located on the retrofitted bed/cart 326, the vertical supports 312 and the telescoping portion 322 move to their retracted positions. Once the horizontal transfer is complete, the vertical drive system 342 is lowered and the transfer sheet 302 is disengaged.

An alternative embodiment 400 is shown in FIG. 24. Head portion 402 and foot portion 404 are similar in construction to head frame 304 and foot frame 306 respectively except that head portion 402 and foot portion 404 lack lifting supports 324 attached to the telescoping portion 320 and have instead top supports 406 which support upper transverse support 408. The upper transverse support 408 provides support to counter the forces from the weight of the patient.

Upper transverse support 408 has transverse tracks 410 on both sides of upper transverse support 408 which support lifting elements 412. Lifting elements 412 have track wheels 414 which rotate within the tracks 410 yielding transverse motion of the lifting elements 412. Lifting elements 412 contain winches (not shown) for retracting cords 416. Cords 416 have fasteners 418 at their ends for attaching to reinforced holes or grommets 420 at the corners of a draw sheet 422. Retraction of cords 416 raises draw sheet 422 which contains a patient secured within the sheet 422.

As shown in FIG. 25, extendable horizontal supports 424 operate similarly to extendable horizontal supports 314 to allow the lateral motion of the vertical supports 426 on wheels 428 along with upper transverse support 408 and lifting elements 412. As with the previous embodiment 300, the alternative embodiment 400 can move a patient from the retrofitted bed/cart 400 to a second bed/cart or from a second bed/cart to the retro fitted bed/cart 400.

Figure 26:
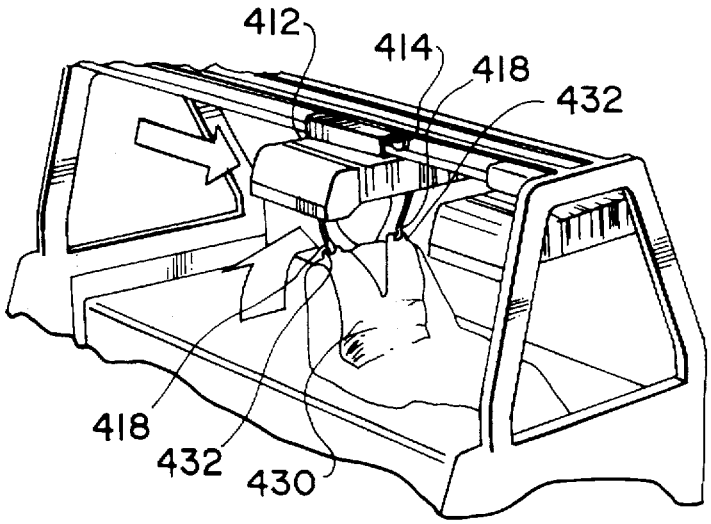
FIG. 26 is a perspective view of the alternative embodiment of FIG. 24 being used to assist a patient to sit up.
Figure 27:
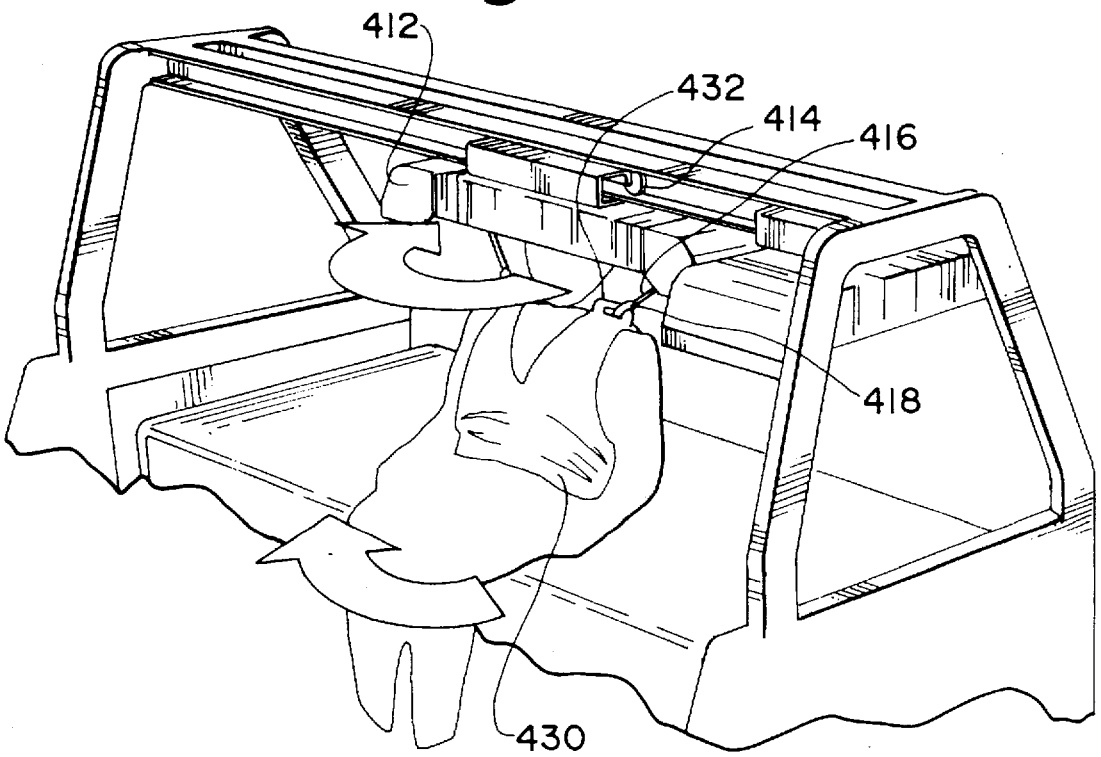
FIG. 27 is a perspective view as in FIG. 26 indicating the rotation of a lifting element.

Alternatively, referring to FIGS. 26, 27, a single lifting element 412 can be used along with a lift jacket 430. Lift jacket 430 fits around the torso of a patient. Fasteners 418 attach to loops 432 on lift jacket 430. When attached to a lift jacket 430, retraction of cords 416 lifts the patient's torso off the bed into a bent position at the patient's waist. The lifting element 412 can then be translated and rotated as shown in FIGS. 26 and 27 to place the patient in a seated position at the side of the bed. The patient's back is supported in this position. In this way the horizontal transfer device 400 serves a second purpose in assisting a patient into a sitting position from a supine position on a bed.

Figure 28:
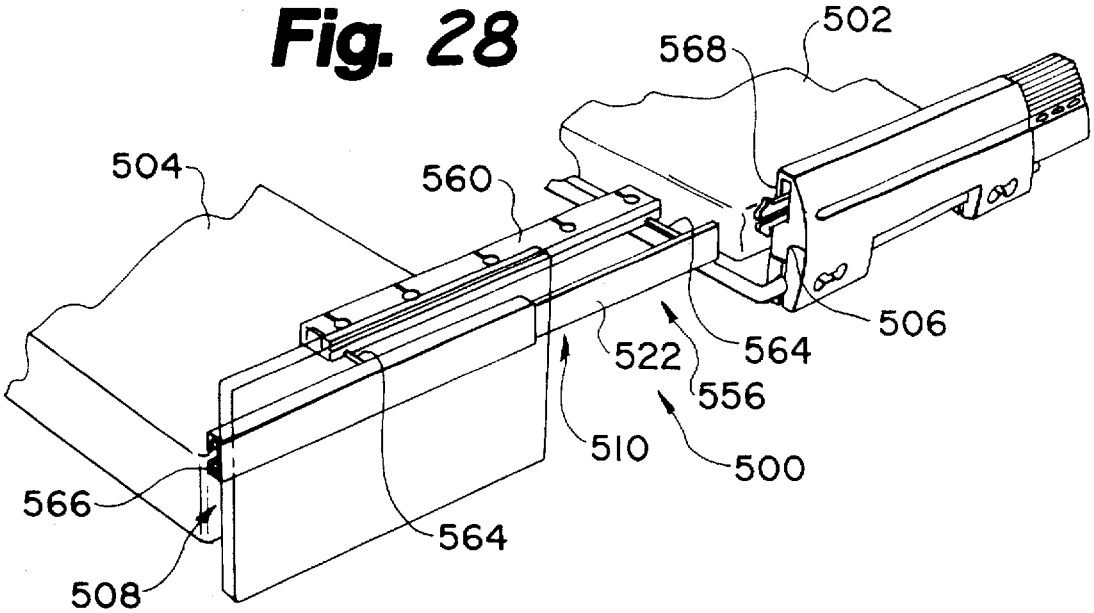
FIG. 28 is a perspective view of a transfer system with a horizontal transfer mechanism.
Figure 29:
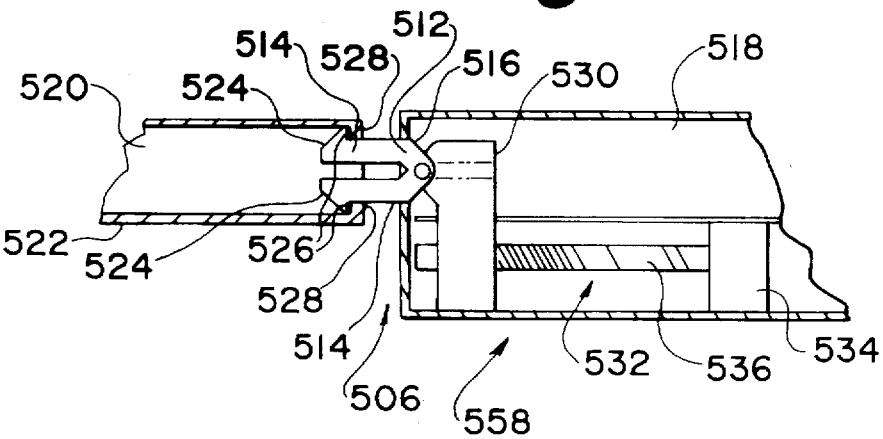
FIG. 29 is a cut away side view of one embodiment of a docking mechanism.
Figure 30:
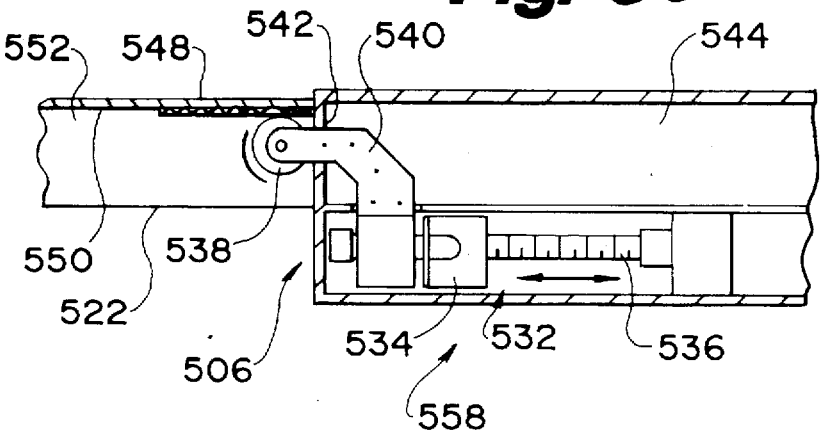
FIG. 30 is a cut away side view of a second embodiment of a docking mechanism.

A transfer system 500 designed for retrofitting of both the bed 502 and the cart 504 is depicted in FIG. 28. The transfer system 500 includes a horizontal transfer mechanism 508 and a transfer bridge 510 (FIG. 32–35). The horizontal transfer mechanism includes a docking mechanism 506. FIGS. 29 and 30 depict two representative embodiments of the docking mechanism 506. The first embodiment has a spring loaded clamp 512 with arms 514. Arms 514 protrude from an opening 516 at the side of the foot board 518 of bed 502. Spring loaded clamp 512 engages a cavity 520 opening into transfer bar 522. When the angled front edge 524 of the arms 514 engage cavity 520, the arms 514 deflect towards each other against the spring (not shown) until tips 526 clear flanges 528 at which point the arms return outward as tips 526 engage flanges 528. Arms 514 pivot on a docking support 530 within the bed foot board 518. The head boards (not shown) have a comparable docking mechanism. When the clamp 512 is protruding from opening 516, the arms can be disengaged by pressing arms 514 together.

In the second embodiment of the docking mechanism 506 depicted in FIG. 30, a gear 538 supported by a docking support 540 protrudes from an opening 542 in the side of the bed foot board 544. Protruding gear 538 engages teeth 548 in the top surface 550 of cavity 552 within transfer bar 522. Gear 538 can flex slightly on its support 540 to engage the teeth 548. Cavity 552 within transfer bar 522 does not have flanges at its opening. The gear 538 is disengaged by pressing downward on docking support 540 when docking support 540 is protruding from opening 542. Again, the head boards (not shown) have a comparable docking mechanism.

The two embodiments of the docking mechanisms 506 are described in a particular configuration with respect to the cart and the bed. This configuration can be reversed with the bed holding the protruding gear 532 or clamp 512. In either configuration, the protruding gear or clamp can be retracted by the worm gear drive 532 when docking is being performed.

Figure 31:
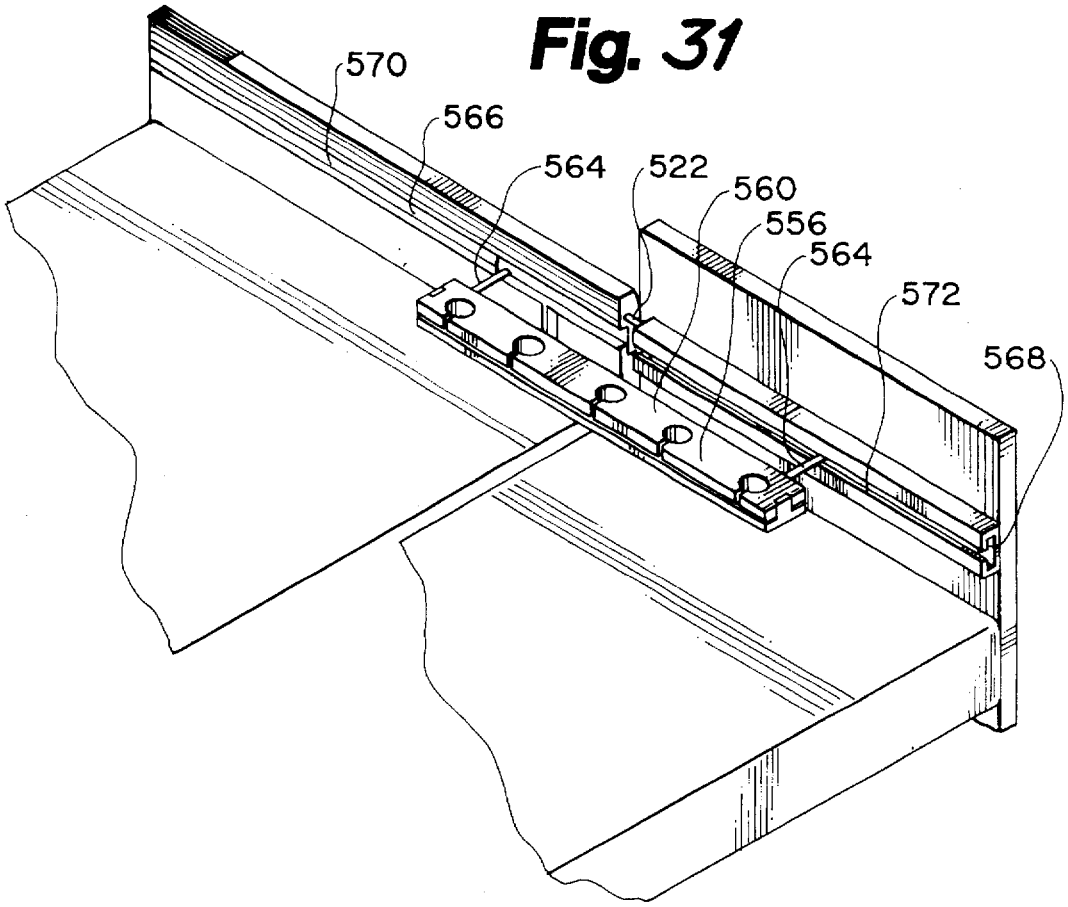
FIG. 31 is a perspective view of the transfer system of FIG. 28 with a transfer element bridging between a bed and a cart.

The horizontal transfer mechanism 508 includes a transfer element 556 and a drive system 558. Transfer element 556 has a gripping mechanism 560 for gripping a transfer sheet such as transfer sheet 302 in FIGS. 22 and 23 and transfer bar 522 (FIG. 31). The gripping mechanism 560 is attached to transfer bar 522 by a plurality of support bars 564. Gripping mechanism 560 can be similar to sheet clamp 325. Transfer bar 522 moves within cart channel 566 and bed channel 568. Support bars 564 slide within slots 570 and 572 within cart channel 566 and bed channel 568 respectively. The docking supports 530 or 540 can be moved laterally by drive system 558 which can comprise a worm gear drive 532 (FIGS. 29, 30). The worm gear drive 532 has a motor 534 and a worm 536. The rotation of worm 536 moves the docking supports 530 or 540. The motion of the docking supports 530 or 540 moves the transfer bar 522 within channels 566 and 568 (FIG. 28). The worm gear drive 532 can move the transfer bar 522 in either direction to effect the movement of the patient in either direction.

Figure 32:
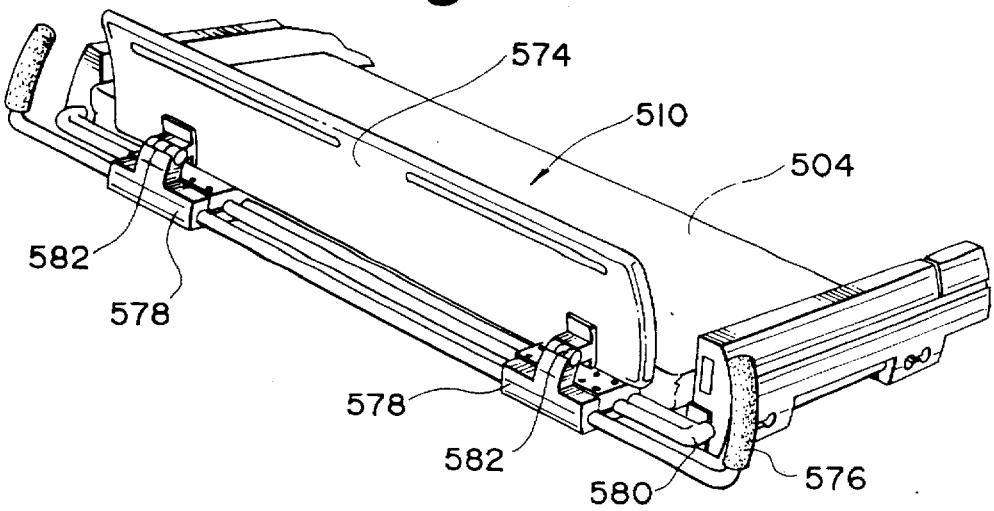
FIG. 32 is a perspective view of a transfer bridge used with the transfer system of FIG. 28.
Figure 33:
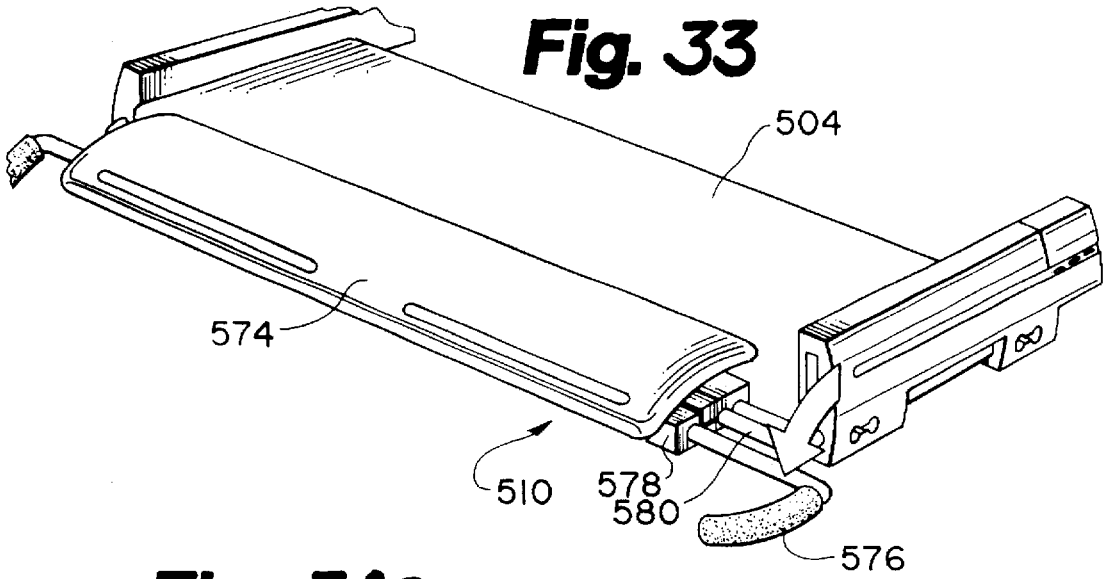
FIG. 33 is a perspective view of the transfer bridge of FIG. 32 with the bridge in the bridging position.
Figure 34A:
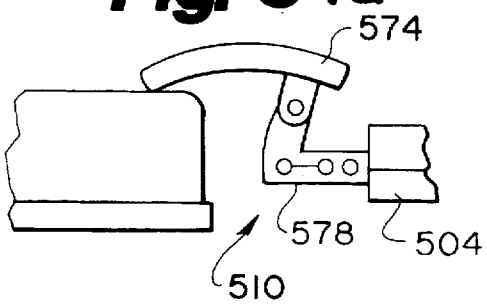
FIG. 34*a* is a side view of the transfer bridge in the bridging position with lever and rods removed.
Figure 34B:
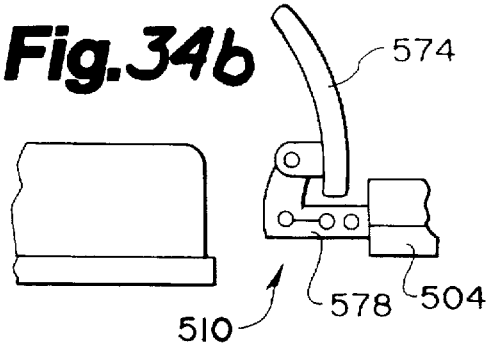
Figure 35:
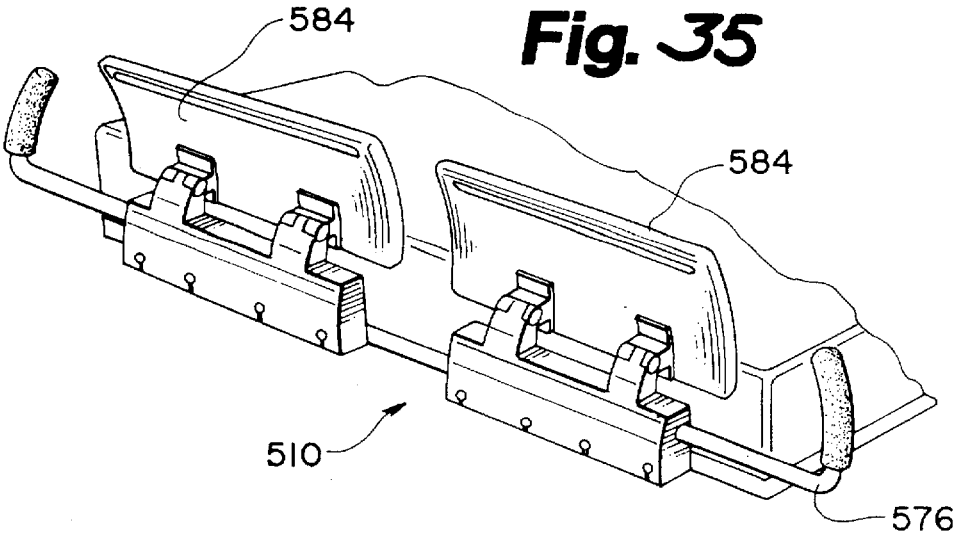
FIG. 35 is a perspective view of a split transfer bridge.

Transfer bridge 510 is mounted on the side of cart 504 (FIGS. 32, 33). Transfer bridge 510 has a bridge 574, lever 576 and mounting portions 578. Bridge 574 is preferably molded from a low friction material such as, for example, polypropylene, to facilitate the passage of the transfer sheet. It is recognized that other low friction materials may also be suitable. Mounting portions 578 are attached to the side of the cart 504 by rods 580. Mounting portions 578 have a hinge 582 which supports bridge 574. Lever 576 passes through mounting portions 578. Rotation of lever 576 changes the configuration of hinges 582 thereby moving bridge 510 between a stored position and a bridge position, as shown in FIGS. **32–34*b*. In the bridge position, bridge 574 fills in the gaps between the bed 502 and cart 504. In the storage position, the bridge 574 acts as a side rail for the cart 504. FIG. 35 depicts a slightly different embodiment of the transfer bridge 510 having a split transfer bridge 584**. These embodiments of the transfer bridge can be adapted for use with other transfer systems including the conventional manual transfer system.

To transfer a patient between the bed 502 and cart 504, the transfer sheet 302 is attached to the gripping mechanisms 560 at the head and foot of the patient's resting place, similar to the attachment of transfer sheet 302 in the embodiment of FIG. 14. Referring to FIG. 31, the cart 504 and bed 502 are positioned to align channels 566 and 568. Referring to FIG. 33, the transfer bridge 510 is placed in its transfer position to fill the gap between the bed 502 and the cart 504. As shown in FIG. 31, the drive system 558 is engaged to move the transfer element 556 from the bed 502 or cart 504 where the patient was located to the bed 502 or cart 504 where the patient is being transferred. Once the patient is transferred, the cart 504 and bed 502 are undocked, and the transfer sheet 302 is disconnected from the gripping mechanisms 560.

The above transfer systems rely on supporting the patient on some type of sheet during the transfer. While relying on a sheet is similar to often used present methods with health care personnel providing the transfer forces, supporting the patient on a sheet may be inappropriate for patients with certain injuries. For these patients it would be safer to transfer the entire mattress or cushion, as described below.

Figure 36:
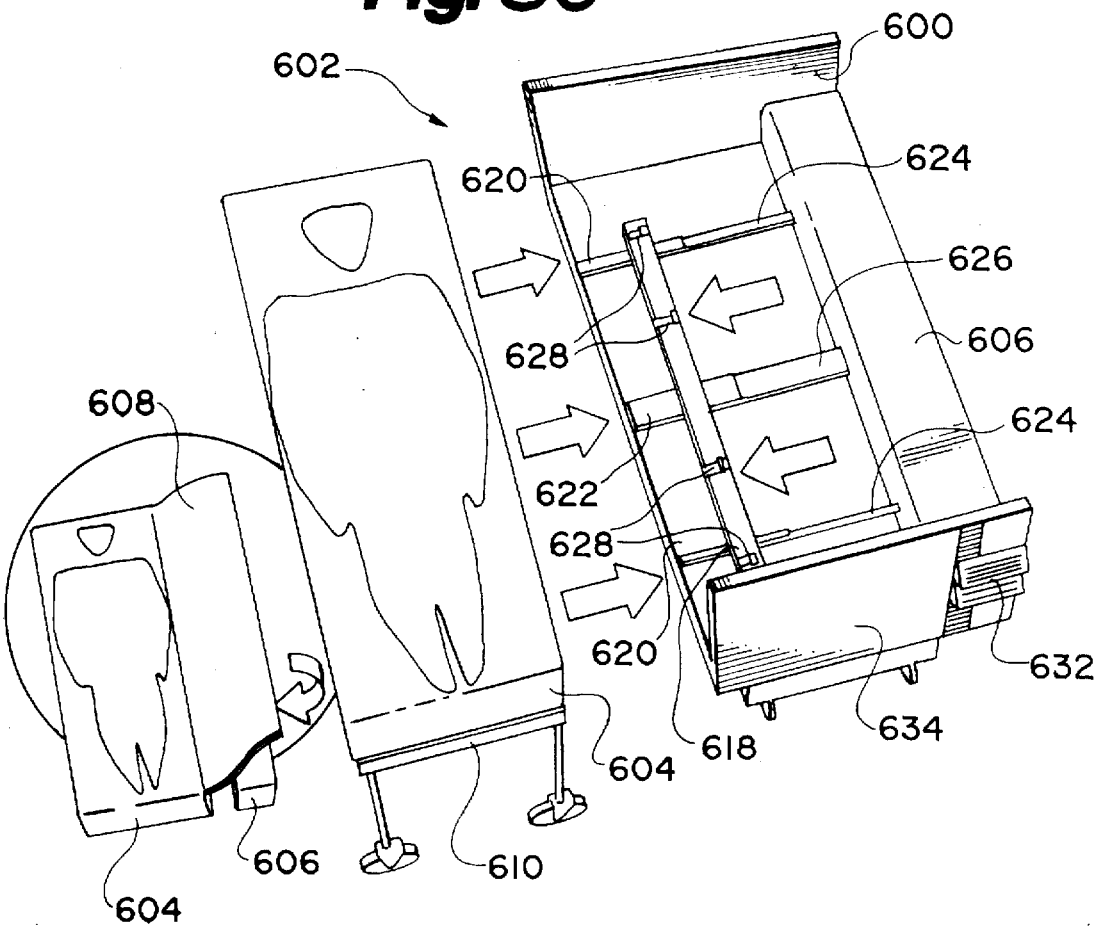
FIG. 36 is a perspective view of a mattress transfer system.
Figure 37:
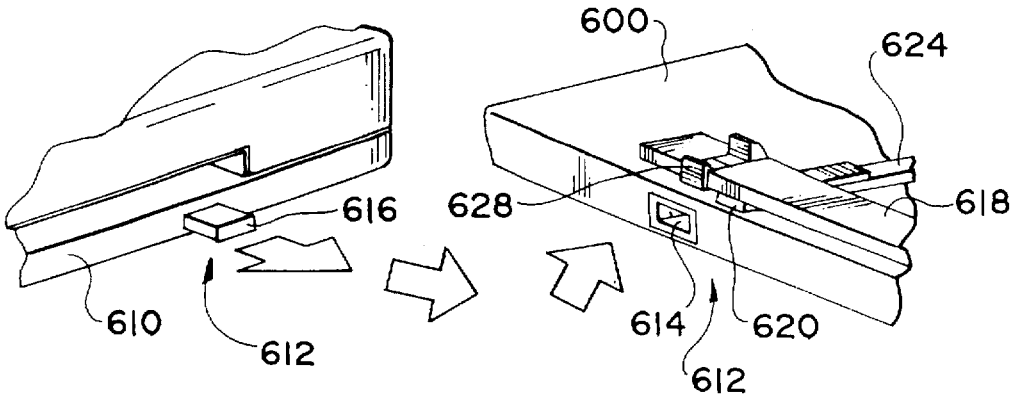
FIG. 37 is a perspective view of a docking mechanism used with the mattress transfer system of FIG. 36.

FIG. 36 displays a bed 600 including a mattress transfer system 602. The bed 600 supports a modular mattress 604 and a fixed cushion 606. The modular mattress 604 has wing 608 of padded fabric that wraps around fixed cushion 606 to form a smooth surface without any gaps, as shown in the insert of FIG. 36. Wing 608 tucks under the modular mattress 604 when not in use. Referring to FIG. 37, bed 600 connects with cart 610 by way of a docking mechanism 612 when the mattress 604 is to be transferred. The docking mechanism 612 has one or more apertures 614 for accepting projections 616. FIG. 37 displays apertures 614 on bed 600 and projections 616 on cart 610, but the opposite arrangement would work similarly. It is possible to have a locking mechanism (not shown) to lock projections 616 in apertures 614 to prevent relative motion of the bed 600 and cart 610 when the modular mattress 604 is being transferred, but the same effect can be accomplished by locking the wheels of the cart 610.

Figure 38A:
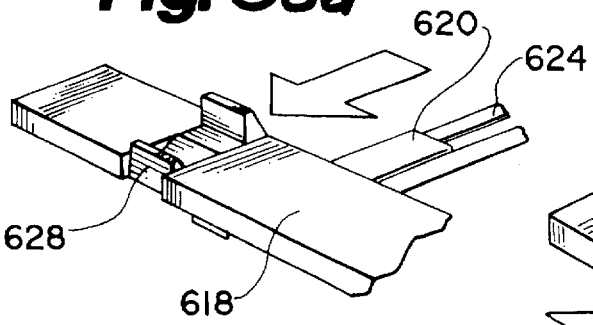
FIG. 38*a* is a perspective view of a gripping mechanism of the mattress transfer system in pushing position.
Figure 38B:
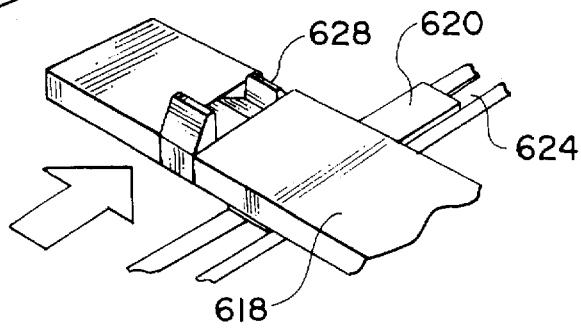
FIG. 38*b* is a perspective view of a gripping mechanism of the mattress transfer system in pulling position.

In one embodiment, the mattress transfer system 602 has a transverse bar 618 connected to a plurality of lateral bars 620 and at least one lateral drive bar 622. Lateral bars 620 slide along lateral tracks 624 while lateral drive bar 620 engages lateral drive track 626. The lateral bars 620 and lateral drive bars 622 allow the transverse bar 618 to extend just past the edge of bed 600. Transverse bar 618 has a plurality of gripping mechanisms 628. Each gripping mechanism 628 has a pushing position (FIG. 38*a*) and a pulling position (FIG. 38*b*) for pulling and pushing the modular mattress respectively.

Figure 39:
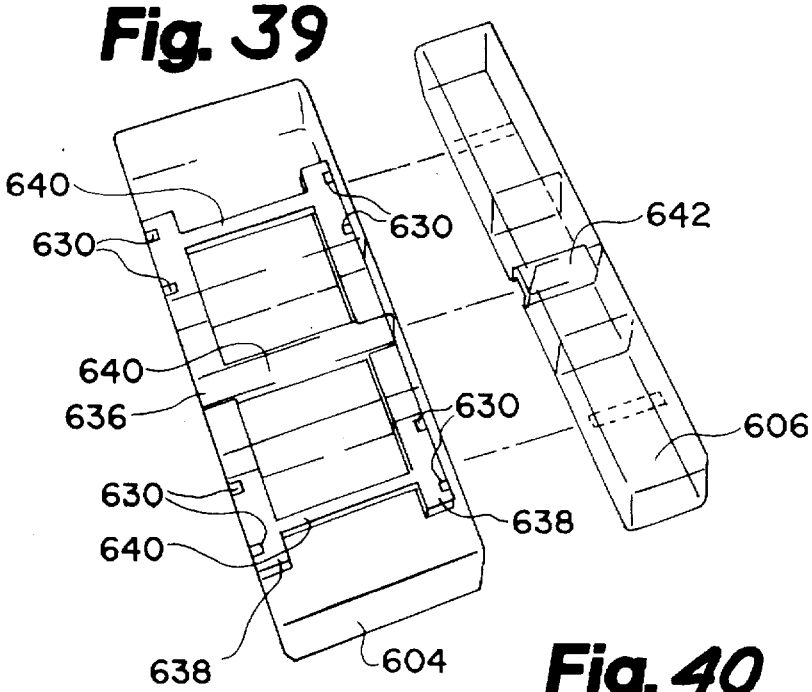
FIG. 39 is an exposed, top perspective view of a mattress and fixed cushion of the mattress transfer system indicating the location of structures within and below the mattress and cushion.
Figure 40:
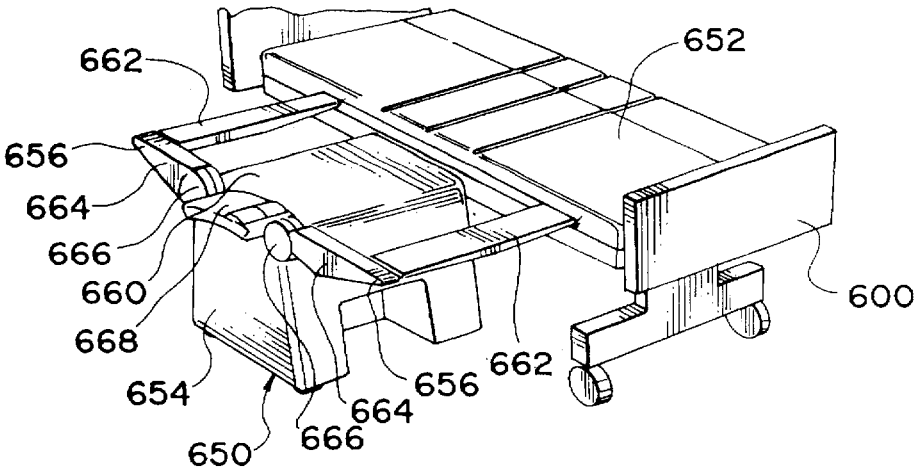
FIG. 40 is a perspective view of a mattress transfer system used with a position changing cart and a folding mattress.
Figure 47:
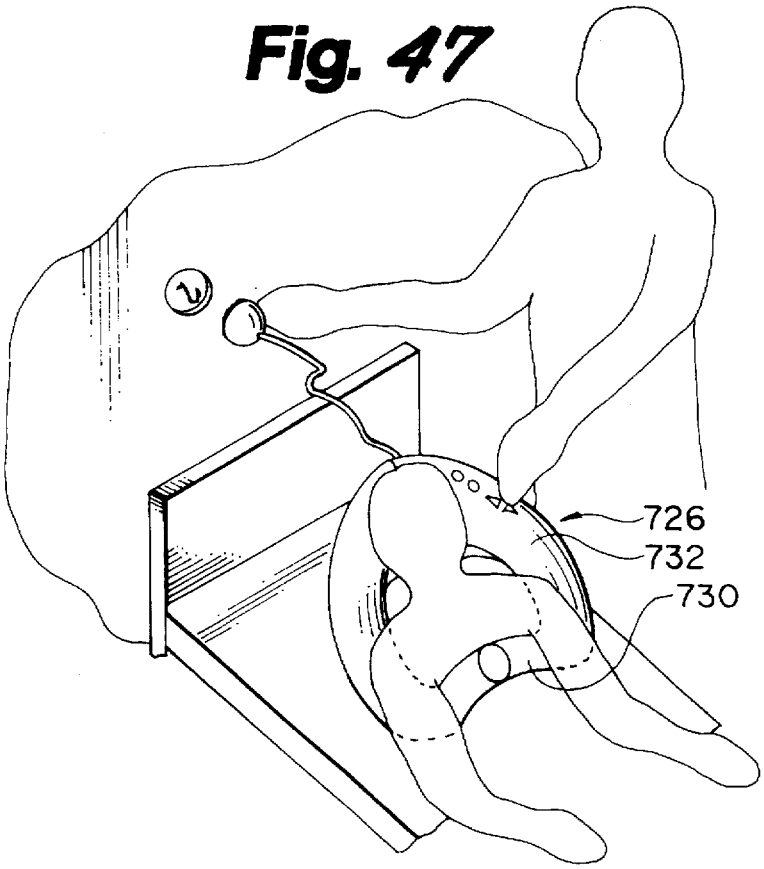
FIG. 47 is a perspective view of a motorized bed jacket being attached to a mount above a headboard.
Figure 49:
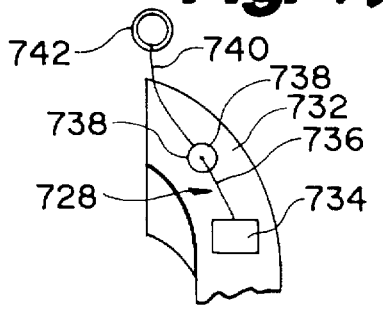
FIG. 49 is a partial cut away view of the drive system of the motorized bed jacket.
Figure 48:
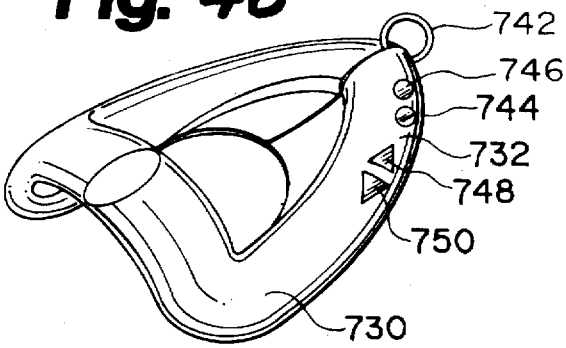
FIG. 48 is a top perspective view of the motorized bed jacket.

Referring to FIGS. 36 and 39, the gripping mechanisms 628 grip handles 630 near the edge of modular mattress 604. The mattress transfer system is controlled from a control panel 632 mounted on the foot board 634, as shown in FIG. 36. Operation of the mattress transfer system 602 moves the transverse bar 618 either toward or away from cart 610 by moving the lateral drive bar 622 accordingly. Of course, a variety of designs are possible for the mattress transfer system 602 besides the embodiment described.

Referring again to FIG. 39, the modular mattress 604 has a channel system 636 to accommodate the transfer system 602. The channel system includes a transverse void 638 to accommodate transverse bar 618 and longitudinal channels 640 to accommodate the lateral tracks 624 and lateral drive tracks 626. Handles 630 are located along the upper surface of transverse void 638. To the extent necessary, fixed cushion 606 may also have appropriate channels 642.

In order to transfer the modular mattress 604, the cart 610 is first docked with bed 600 using docking mechanism 612. If the modular mattress is being moved to the cart 610, the patient is centered on the modular mattress 604, and the gripping mechanisms 628 are set from control panel 632 in their pushing position. The mattress transfer system 602 is operated to move the transverse bar 618 toward cart 610. When the mattress is located on cart 610, the docking mechanism 612 is disengaged.

If the modular mattress 604 is being moved from the cart 610 to the bed 600, the cart 610 and bed 600 are docked appropriately. Then, the transverse bar 618 is placed in its extended position within transverse void 638. The gripping mechanisms 628 are placed in their pulling position. The mattress transfer mechanism 602 is operated to move transverse bar 618 away from cart 610. When the modular mattress 604 is in position on bed 600, the mattress transfer system 602 is stopped, and the docking mechanism is disengaged.

The bed 600 with the mattress transfer system 602 can be adapted to work with a position changing cart 650 when used with a folding mattress 652, as shown in FIGS. 38*a*–41. The position changing cart 650 has a base 654 and a plurality of, preferably two, arms 656. Base 654 has a plurality of locking wheels 658 providing a relatively broad base of support for cart 650. The base should have sufficient weight and a relatively low center of mass such that cart 650 is stable. The top 660 of base 654 provides support for the center of folding mattress 652 when the mattress 652 is positioned on cart 650.

Arms 656 have a support portion 662 and a lever portion 664. Support portions 662 extend laterally toward bed 600 from the far edge of the cart 650. Lever portions 664 are rigidly attached to support portions 662 at one end and are attached to a hinge mechanism 666 at base 654. Support portions 662 support folding mattress 652 when the mattress 652 is positioned on cart 650. The folding drive within base 654 is operated from a control panel 668 at the side of base 654. The folding drive operates to rotate hinge mechanisms 666 to change the configuration of folding mattress 652 from a prone configuration to a seated configuration as in FIG. 42 or visa versa.

When going from a supine to a seated configuration, the lever portion 664 at the head of the mattress 652 rotates upward and the lever portion 664 at the foot of the bed 400 rotates downward. Folding mattress 652 has creases 670 to accommodate the change in configurations. The movement of the folding mattress 652 on and off of position changing cart 650 is analogous to moving the modular mattress 604 on and off of cart 610.

The next devices are designed to hoist or pull up a patient on a bed or a chair. These systems are configured with at least one lifting device and at least one winch system. In a first embodiment 700 of the hoist system, the lifting device is a lobster claw shaped bed jacket 702, as shown in FIGS. 43*a*–*c*. The bed jacket 702 has two claw portions 704 joined at joint 706. Claw portions 704 are, in one embodiment, made of fabric enclosing padding of some kind. Joint 706 involves folds in the fabric that yield greater flexibility at the joint 706. The bed jacket 702 is easy to put on the patient because no part of it fits under the mid-torso of the patient. The lifting forces, however, are distributed across the patient's chest, while the neck is supported by the claw portions.

Claw portions 704 have edges 708 at their ends opposite joint 706. Edges 708 of opposing claws 704 can be joined by a hook and loop fastener 710, with clips (not shown), or other suitable fastener. The edges 708 do not necessarily have to be joined in contact. In use, joint 706 is placed across the patient's chest, and the claw portions are placed under the patient's arms. Edges 708 are joined behind the patient's neck, if desired. If the edges are not joined, they will still be held together by their attachment at their respective ends to the same winch.

Figure 44:
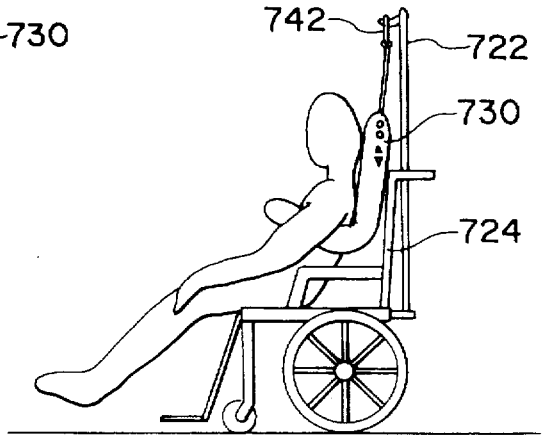
FIG. 44 is a perspective view of a motorized bed jacket attached to a stand above a wheel chair.

Bed jacket 702 can be used with at least two embodiments of the winch system. In a first embodiment of the winch system 712, shown in FIG. 43*c*, the bed jacket 702 has a loop 714 for the attachment of a tether 716. The tether 716 is attached to an external winch 718. Depending on its intended use, the external winch 718 can be attached to a bed's head board 720, located on a support 722 elevated above a bed or wheel chair 724 (FIG. 44) or mounted to a ceiling (FIG. 43*c*). External winch 718 can be operated manually with a hand crank (not shown) or with a motor (not shown) controlled by a control panel.

Figure 45:
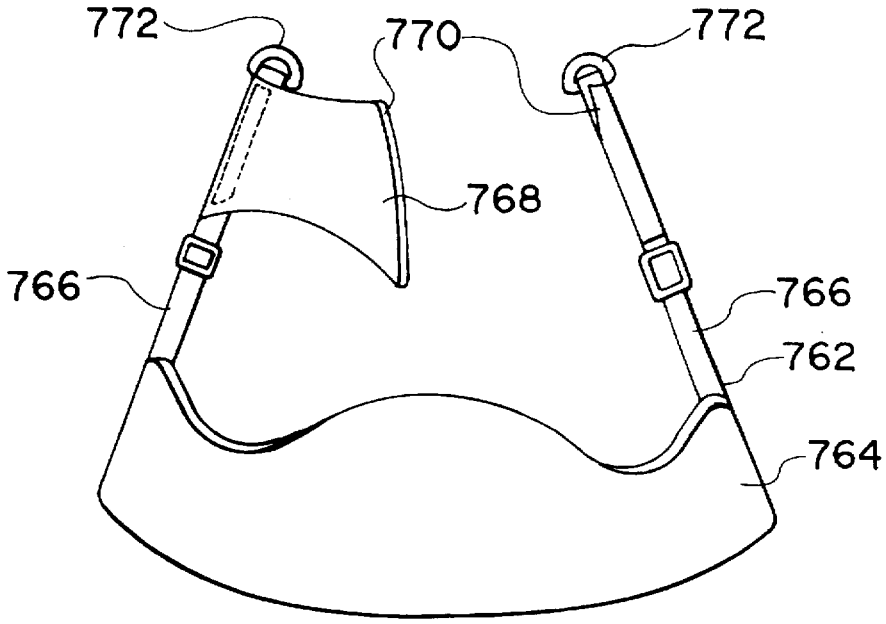
FIG. 45 is a front view of a padded vest.
Figure 46:
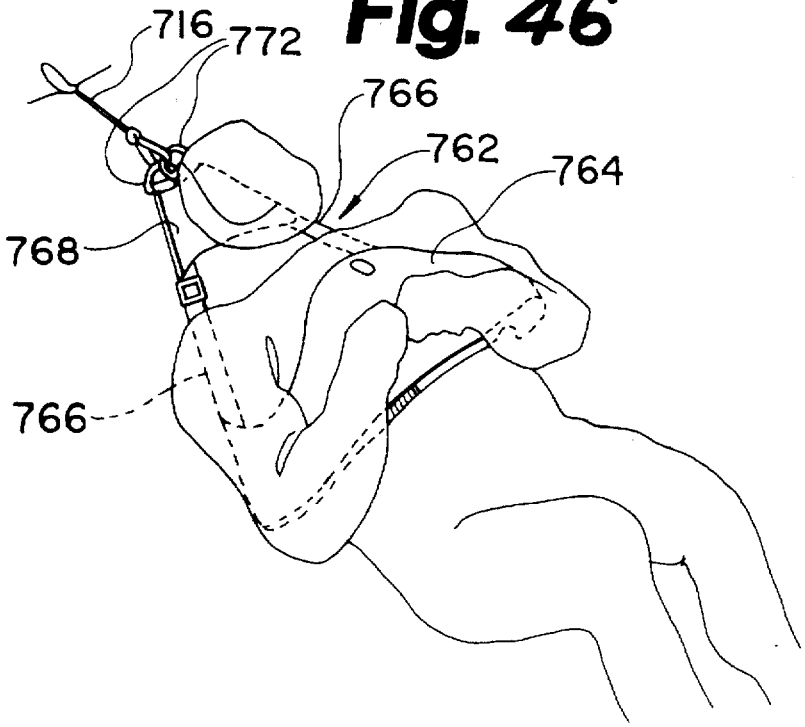
FIG. 46 is a perspective view of the padded vest around a person and attached to a tether where hidden portions of the vest are depicted with phantom line.

External winch 712 can also be used with padded vest 762 shown in FIGS. 45 and 46. The padded vest 762 has the same advantages as the lobster claw bed jacket 702. The padded vest 762 has a foam portion 764 that fits across the user's chest. Two adjustable straps 766 extend from the foam portion 764. One strap 766 has a head support 768 attached. The free end of the head support 768 is attached with a hook and loop fastener 770 or a comparable fastener to the other strap 766. Rings 772 attached to the end of straps 776 attach the vest 764 to a tether 716 for connection to a winch 718.

A second embodiment of the winch system 726 has a winch mechanism 728 within the bed jacket 730 itself, as shown in FIGS. 44, 47–49. The winch mechanism 726 is preferably motorized. The winch mechanism 728 is embedded in one of the claws 732 of the bed jacket 730, although the winch can be imbedded in other designs of bed jackets. The preferred winch mechanism 728 has a motor 734 which rotates a drive shaft 736 connected to a spool 738. Tether 740 is attached to spool 738 and has a ring 742 on its end.

Controls which can be found on claw 732 include a release switch 744, a recoil switch 746, a pull switch 748 and a lower switch 750. The release switch 744 releases the spool 738 so that the tether 740 can be pulled from bed jacket 730. The recoil switch 746 winds up tether 740 on spool 738 using a spring mechanism (not shown) assuming that there is little resistance on the tether 740. The pull switch 748 activates the motor 734 to wind tether 740 on spool 738, and the lower switch 750 runs the motor 734 in the opposite direction releasing tether 740 from spool 738. Optionally, the controls may be placed external to the bed jacket such as in a remote control unit or mounted to the bed. The external control units would communicate with the winch mechanism 728 either through a wired or wireless (transmitter/receiver) communication similar to the control unit for the embodiment in FIGS. 11 and 12.

The ring 742 can be attached to a head board, an elevated support on a wheel chair or a ceiling mount such that the motorized bed jacket 730 can be used in the same way as the non-motorized counterpart. The winch bed jacket combination 730 is more versatile because it can be used in a variety of ways without the need for having a variety of separate winches. Furthermore, the controls are conveniently located such that the health care worker can operate the controls while being close enough to the patient to assist in their motion.

Figure 50:
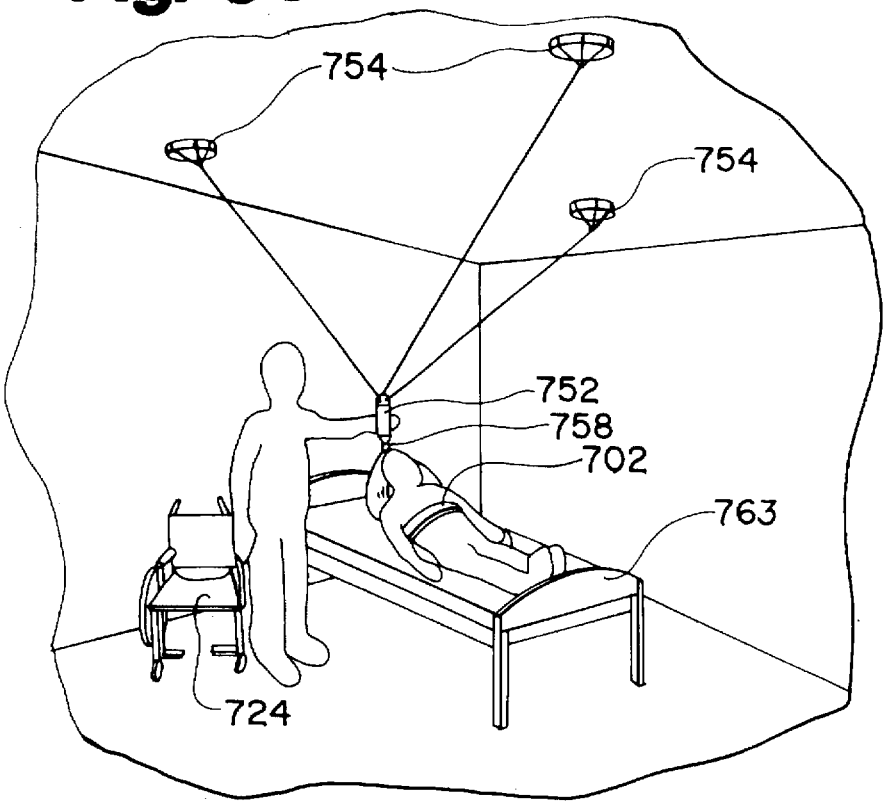
FIG. 50 is a perspective view of a bed jacket attached to three hoisting mechanism on a ceiling using a three way control cylinder.
Figure 51:
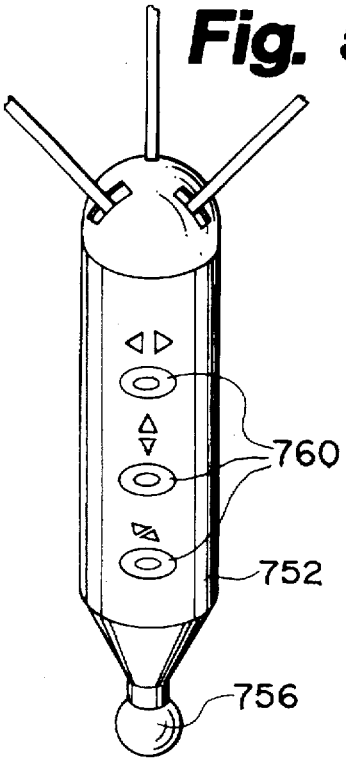
FIG. 51 is a side perspective view of the three way control cylinder.
Figure 52:
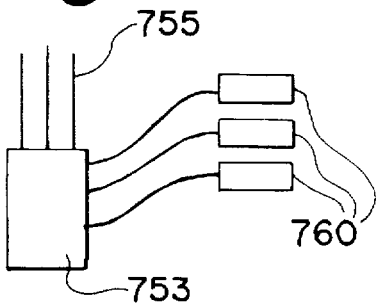
FIG. 52 is a schematic view of the internal components of the three way control unit.

Finally, bed jacket 702 can be connected by way of a three axis control cylinder 752 to three ceiling mounted winches 754, as shown in FIGS. 50 and 51. The control cylinder 752 connects to bed jacket 702 by way of ball 756 which fits into a ball joint 758. Control cylinder 752 has three switches 760 controlling motion along one of three axes. Referring to FIG. 52, the switches 760 are connected to a microprocessor 753 which has been preprogrammed with the locations of winches 754. The microprocessor 753 uses simple geometry to calculate instructions used to control winches 754 to perform the selected motions. Microprocessor 753 is connected to winches 754 by way of wires 755. This versatile system can be used in a variety of ways including transferring a patient from a bed 762 to a wheel chair 724 or pulling a patient up in either a bed 762 or a wheel chair 724. Padded vest 762 can also be used with a three axis control cylinder 752.

Various modifications and alterations of this invention will become apparent to those skilled in the art without departing from the scope and spirit of this invention.

I claim:

1. A transfer system for moving a patient reclining on a transfer sheet between a first horizontal surface and a second horizontal surface, comprising:

a winch apparatus configured for positioning adjacent to either of said first or second horizontal surfaces, the winch apparatus including a drive, an axle rotated by the drive and at least one reel attached to the axle;

at least one strap with a first end and a second end, the first end of the strap attached to the reel and the second end of the strap having a fastening device; and a clamping device having at least one corresponding fastener for the attachment to the fastening device at the second end of the strap, the clamping device comprising a rigid structure forming a cavity, with the cavity being formed by two curved sections, and the cavity having a releasable catch at its opening such that said transfer sheet can be held within the cavity by the catch until the catch is released to remove the sheet from the cavity, said clamping device further comprising a functional hinge proximate said cavity.

2. The transfer system of claim 1, further comprising a rod which cooperates with the clamping device for holding the sheet.

3. The transfer system of claim 2, wherein the rod is tethered to the clamping device.

4. The transfer system of claim 1, wherein the opening to the cavity has a hinged L-shaped closure.

5. The transfer system of claim 1, wherein the winch apparatus is motorized.

6. The transfer system of claim 1, wherein the winch apparatus is manually operated.

7. The transfer system of claim 1, wherein the at least one strap is comprised of two straps attached to two reels which are spaced apart.

8. A method of transferring a patient reclining on a transfer sheet between a first horizontal surface and a second horizontal surface, the method comprising the steps of:

providing a winch mechanism including means for actuating the winch mechanism and a first reel in mechanical communication with said winch mechanism;

configuring a clamping device with a releasable catch disposed as an opening of a cavity within the clamping device:

placing a rod adjacent the patient and folding a portion of the transfer sheet over the rod:

securing the transfer skeet to the clamping device where the clamping device releasable catch is at the opening of the cavity;

verifying connection of a first strap to the first reel and to the clamping device; and actuating the winch mechanism to wind the first strap onto the first reel thereby transferring the patient from the first horizontal surface to the second horizontal surface.

9. The method of claim 8, wherein a second strap is also attached to the clamping device and where both straps are simultaneously wound onto respective reels to effectuate the transfer.

10. The method of claim 8, wherein a tucking device is used to assist with securing the transfer sheet to the clamping device.

11. A device for releasibly and securely clamping a sheet, comprising:

a substantially rigid, elongate first member with a length, an exterior surface, an interior surface, a first edge and a second edge generally opposite the first edge, the first member generally outwardly curved in cross section for at least a portion of the exterior and interior surfaces;

a substantially rigid, elongate second member with a length, an exterior surface, an interior surface, a first edge and a second edge generally opposite the first edge, the second member generally outwardly curved in cross section for at least a portion of the exterior and interior surfaces, the first edge of the first member in proximal juxtaposition to the first edge of the second member, the second edge of the first member spaced apart from the second edge of the second member, the interior surface of the first member facing the interior surface of the second member, and the first edges of the first and second members being integral;

a substantially rigid, third member with an interior surface, an exterior surface, a length, a first edge and a second edge, the length of the third member generally equaling the lengths of the first and second members, the third member pivotally affixed proximate the second edge of the first member, the first edge of the third member proximate the interior surface of the second member, and the third member further comprising a first generally planar section and a second generally planar section the first and second planar sections integrally joined at a bend, the first planar section angling toward the first edges of the first and second members, the second planar section pivotally joined to the first member proximate the second edge of the first member;

a plurality of attaching devices, the attaching devices having a portion generally L-shaped in cross section and being connected to the exterior surface of the device; and a generally cylindrical rod, the rod positionable proximate the interior surfaces of the first and second members.

12. The device of claim 11, in which the rod has a diameter and in which the red diameter is less than a distance between the second edge of the first member and the second edge of the second member.

13. A device for releasibly and securely clamping a sheet, comprising:

a substantially rigid, elongate first member with a length, an exterior surface, an interior surface, a first edge and a second edge generally opposite the first edge, the first member generally outwardly curved in cross section for at least a portion of the exterior and interior surfaces;

a substantially rigid, elongate second member with a length, an exterior surface, an interior surface, a first edge and a second edge generally opposite the first edge, the second member generally outwardly curved in cross section for at least a portion of the exterior and interior surfaces, the first edge of the first member in proximal juxtaposition to the first edge of the second member, the second edge of the first member spaced apart from the second edge of the second member, the interior surface of the first member facing the interior surface of the second member, and the first edges of the first and second members being integral;

a substantially rigid, third member with an interior surface, an exterior surface, a length, a first edge and a second edge, the length of the third member generally equaling the lengths of the first and second members, the third member pivotally affixed proximate the second edge of the first member, the first edge of the third member proximate the interior surface of the second member, and the third member further comprising a first generally planar section and a second generally planar section, the first and second planar sections integrally joined at a bend, the first planar section angling toward the first edges of the first and second members, the second planar section pivotally joined to the first member proximate the second edge of the first member; and a plurality of attaching devices, the attaching devices including a portion generally L-shaped in cross section and being connected to the exterior surface of the device; and a winch system operably connected to at least one of the attaching devices.

14. The clamping device of claim 13, in which the winch system is at least partially disposed within the clamping device.

15. The clamping device of claim 14, in which the winch system includes a winch mechanism and a strap apparatus.

16. The clamping device of claim 15, in which the winch mechanism includes a winch and an electric motor.

17. The clamping device of claim 16, in which the winch mechanism further comprises a control mechanism, the control mechanism operable at a distance from the clamping device.

18. The clamping device of claim 16, in which the strap apparatus includes a pliable strap and a handle.

19. The clamping device of claim 17, in which the control mechanism is detachable from the clamping device.

20. A method of ergonomically transferring a patient reclining on a sheet, comprising the steps of:

providing a clamping device having a first member and a second member, each member with a first edge and a second edge, the first edge of the first member functionally disposed proximate the first edge of the second member, the second edge of the first member spaced apart from the second edge of the second member, thereby defining a gap;

inserting at least one portion of the sheet within the clamping device by providing an elongate rod having a diameter smaller than the gap between the second edges of the first and second members of the clamping device and folding at least one portion of the sheet about the rod, such that at least one fold is formed about the rod with at least one free end of the sheet extending from the rod, and in which the step of inserting at least one portion of a sheet within the clamp further comprises inserting the rod and at least one fold within the clamping device so that the at least one free end of the sheet is clamped by the clamping device when the retracting force is exerted; and exerting a retracting force on the damping device, the retracting force exerted away from the patient and acting to securely and reversibly clamp the at least one portion of the sheet within the clamping device, the retracting force further moving the clamping device, the clamped sheet and the patient reclining thereupon.

21. The method of claim 20, in which the step of providing a rod further comprises disposing the rod near the patient such that the wrapped rod is disposable within the clamping device and such that the clamping device is disposed proximate the patient when the wrapped rod is disposed within the clamping device.

22. The method of claim 20 or 21, in which all steps are performable by a single operator.

23. A method of clamping a sheet, comprising the steps of:

providing a clamping device, the clamping device with a longitudinal axis and including:

a substantially rigid, elongate first member with a length, an exterior surface, an interior surface, a first edge, a second edge, the first member generally outwardly curved in cross section for at least a portion of the exterior and interior surfaces, a substantially rigid, elongate second member with a length, an exterior surface, an interior surface, a first edge and a second edge, the second member generally outwardly curved in cross section for at least a portion of the exterior and interior surfaces, the first edge of the first member rigidly in juxtaposition to the first edge of the second member, the second edge of the first member spaced apart from the second edge of the second member, the interior surface of the first member facing the interior surface of the second member, and a substantially rigid, third member with an interior surface, an exterior surface, a length, a first edge and a second edge, the length of the third member generally equalling the lengths of the first and second members, the third member pivotally affixed proximate to the second edge of the first member, the first edge of the third member proximate the interior surface of the second member in a closed position and pivotable away from the interior surface of the second member in an open position;

pivoting the third member of the clamping device to the open position;

placing a portion of the sheet within the clamping device; and engaging the third member with at least one surface of the sheet, the sheet frictionally contracting the first edge of the third member and the interior surface of the second member.

24. The method of claim 23, in which the step of placing the sheet within the clamping device further comprises:

providing an elongate rod, folding at least one portion of the sheet about the rod such that a loop with at least one free end is formed, the at least one free end overlapping an unwrapped portion of the sheet, and disposing the folded portion of the sheet and the rod within the clamping device;

and in which the step of engaging the third member to at least one surface of the sheet further comprises disposing the at least one free end of the sheet and an unwrapped portion of the sheet between the third member and the second member.

25. A device for releasibly and securely clamping a sheet, comprising:

a substantially rigid, elongate first member with a length, an exterior surface, an interior surface, a first edge and a second edge, the first member generally outwardly curved in cross section for at least a portion of the exterior and interior surfaces;

a substantially rigid, elongate second member with a length, an exterior surface, an interior surface, a first edge and a second edge, the second member generally outwardly curved in cross section for at least a portion of the exterior and interior surfaces, the second member including a bend such that the cross section of the second member defines a lip proximate the second edge of the second member and such that the lip is pointed generally toward the second edge of the first member, the first edge of the first member in proximal juxtaposition to the first edge of the second member, the second edge of the first member spaced apart from the second edge of the second member, the interior surface of the first member facing the interior surface of the second member, the first edges of the first and second members being integral, and the first edges of the first and second members functionally joined by a hinge;

a substantially rigid, third member with an interior surface, an exterior surface, a length, a first edge, a second edge, and an engaging surface on at least a portion of the third member proximate the interior surface of the second member, the length of the third member generally equaling the lengths of the first and second members, the third member generally L-shaped in cross section and with a bend, the first edge of the third member pivotally mounted within the second edge of the first member, the second edge of the third member extending toward the first edges of the first and second members, the bend of the third member disposed proximate the inferior surface of the lip of the second member, the third member pivotally affixed proximate the second edge of the first member, the first edge of the third member proximate the interior surface of the second member, and the third member further comprising a first generally planar section and a second generally planar section, the first and second planar sections integrally joined at a bend, the first planar section angling toward the first edges of the first and second members, the second planar section pivotally joined to the first member proximate the second edge of the first member; and a plurality of attaching devices, the attaching devices having a portion generally L-shaped in cross section and being connected to the exterior surface of the device, in which the attaching devices are generally arcuate in cross section with a terminal lip, the attaching devices being rigidly attached to the interior surface of the first member and extending through a portion of the second member generally toward the first edges of the first and second members, and the lip pointing generally toward the first member.

* * * * *